US007034816B2

(12) United States Patent
Yatabe

(10) Patent No.: US 7,034,816 B2
(45) Date of Patent: Apr. 25, 2006

(54) SYSTEM AND METHOD FOR DRIVING A DISPLAY DEVICE

(75) Inventor: Satoshi Yatabe, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 339 days.

(21) Appl. No.: 09/921,583

(22) Filed: Aug. 6, 2001

(65) Prior Publication Data

US 2002/0126114 A1 Sep. 12, 2002

(30) Foreign Application Priority Data

Aug. 11, 2000 (JP) ..... 2000-244585

(51) Int. Cl.
*G09G 5/00* (2006.01)

(52) U.S. Cl. ..... 345/213; 345/214; 345/212

(58) Field of Classification Search ..... 345/55, 345/50, 91–92, 87, 206, 213–214, 89–90, 345/100, 103, 212
See application file for complete search history.

(56) References Cited

U.S. PATENT DOCUMENTS

| | | | | |
|---|---|---|---|---|
| 5,861,863 | A * | 1/1999 | Kudo et al. | 345/100 |
| 5,867,140 | A * | 2/1999 | Rader | 345/98 |
| 6,018,331 | A * | 1/2000 | Ogawa | 345/99 |
| 6,075,510 | A * | 6/2000 | Blouin et al. | 345/99 |
| 6,137,481 | A * | 10/2000 | Phillipps | 345/173 |
| 6,181,313 | B1 * | 1/2001 | Yokota et al. | 345/100 |
| 6,512,506 | B1 * | 1/2003 | Shimada | 345/99 |
| 6,545,653 | B1 * | 4/2003 | Takahara et al. | 345/87 |
| 6,633,272 | B1 * | 10/2003 | Kumagawa et al. | 345/98 |

FOREIGN PATENT DOCUMENTS

| | | | |
|---|---|---|---|
| CN | 1262761 | A | 8/2000 |
| EP | 0 974 952 | A1 | 1/2000 |
| JP | 31-311981 | A | 11/1999 |
| JP | 2000-122619 | A | 4/2000 |
| JP | 2001-147671 | A | 5/2001 |
| WO | WO 99/40561 | A | 8/1999 |
| WO | WO 01/39166 | A1 | 5/2001 |

* cited by examiner

*Primary Examiner*—Amr A. Awad
*Assistant Examiner*—Leonid Shapiro
(74) *Attorney, Agent, or Firm*—Oliff & Berridge, PLC

(57) ABSTRACT

The present invention provides a system and method for driving a display device where out of a display screen, only pixels at intersections of particular scanning lines and particular data lines are used as a display area. In order to save power, the particular scanning lines are selected one for each horizontal scanning period. For one of the two split halves of the one horizontal scanning period, the selected scanning line is supplied with a selection voltage, and the polarity of the selection voltage is inverted at least every two or more horizontal scanning periods. The scanning lines other than the particular scanning lines are supplied with a non-selection voltage, which is inverted at least every one vertical scanning period. For a duration of time during which the particular scanning lines are selected, the data lines other than the particular data lines are supplied with a non-lighting voltage in accordance with the polarity of the selection voltage applied to the selected scanning line, and the polarity of the non-lighting voltage is inverted every two or more horizontal scanning periods responsive to the period of the polarity inversion of the selection voltage.

15 Claims, 31 Drawing Sheets

(a) RIGHT-SHIFTED MODULATION METHOD (b) LEFT-SHIFTED MODULATION METHOD

: LIGHTING VOLTAGE

SYSTEM AND METHOD FOR DRIVING A DISPLAY DEVICE

BACKGROUND OF THE INVENTION

1. Field of the Invention

The present invention relates to a display device driving method that saves power by placing in a display state only the pixels corresponding to the intersection of particular scanning lines and particular data lines, while placing in a non-display state all other pixels. The present invention also relates to a driving circuit for driving the display device, display device and electronic equipment.

2. Description of Related Art

The number of display dots on display devices used in mobile electronic equipment such as mobile telephones is increasing year by year in order to enable these devices to display more information. On the other hand, mobile electronic equipment must have low power requirements, since they are typically battery operated. For this reason, display devices used in mobile electronic equipment require two seemingly contradictory characteristics: high resolution and low power consumption.

To resolve this problem, a driving method called partial display driving (also simply referred to as partial driving) has been proposed. Partial display driving here refers to a method of generating a display such as that shown in FIG. 31 when a full screen display is deemed unnecessary, such as during standby mode. Specifically, only particular scanning lines are supplied with a scanning signal so that pixels at intersections of the particular scanning lines and the particular data lines are set to work as a display area while the remaining pixels are set to be in a non-display state, thus reducing the consumption of power.

In such a partial display driving method, the scanning lines other than the particular scanning lines (the scanning lines in the non-display area) are supplied with a voltage equal to the intermediate voltage of a data signal supplied to the data line, but since the intermediate voltage needs to be separately generated, and since a circuit driving the scanning lines needs to select the voltage equal to the intermediate voltage, the circuit arrangement for driving the scanning lines becomes complex.

In addition, with such partial display driving, even if only several characters are displayed in the display region, a pixel that is in an area outside the character display and that is located on the same row on which the characters are displayed is included in the display area even though it does not display a character. In a structure in which pixels are simply supplied with a non-lighting voltage through a data line, the frequency with which voltage applied to the data line is switched (switching frequency) is not reduced. Therefore, reducing the power consumption is surprisingly difficult.

SUMMARY OF THE INVENTION

The present invention has been developed in view of the above problem, and it is an object of the present invention to provide a method for driving a display device having low power requirements and a simple construction, a driving circuit for driving the display device, display device, and electronic equipment.

To achieve the above object, in a first aspect of the present invention, a driving method of a display device drives a pixel which is arranged at each of the intersections of a plurality of scanning lines and a plurality of data lines, wherein a pixel at the intersections of particular scanning lines among the plurality of scanning lines and of particular data lines among the plurality of data lines is set to be in a display state while the remaining pixels are set to be in a non-display state. The particular scanning lines are selected, one line for every horizontal scanning period with a selection voltage supplied to the selected scanning line for one of the two split halves of one horizontal scanning period. The polarity of the selection voltage is inverted with respect to an intermediate value between a lighting voltage and a non-lighting voltage, supplied to the data line, every two or more horizontal scanning periods.

Each of the scanning lines other than the particular scanning lines is supplied with a non-selection voltage which is inverted in polarity with respect to the intermediate value every one or more vertical scanning periods. Each of the particular data lines is supplied with a lighting voltage in accordance with content to be displayed on a pixel at an intersection of the selected scanning line and the particular data line, for a period, during which the selection voltage is supplied to the selected scanning line, within one horizontal scanning period for selecting one of the particular scanning lines. The particular data line is supplied with the lighting voltage and the non-lighting voltage for substantially equal periods within the one horizontal scanning period for the selected scanning line, and the data line other than the particular data lines is supplied with the non-lighting voltage for a period during which the particular scanning lines are consecutively selected in response to the polarity of the selection voltage supplied to the selected scanning lines, wherein the polarity of the non- lighting voltage is inverted in synchronization with the period of polarity inversion of the selection voltage.

In accordance with the driving method, the scanning lines other than the particular scanning lines (the scanning lines relating to the pixel area in a non- display state) are supplied with the non-selection voltage which is inverted with respect to the intermediate value every one or more vertical scanning periods. Therefore, the root-mean-square value of the voltage becomes almost zero. Since this arrangement eliminates both the need for generating a voltage corresponding to the intermediate value and the need for selecting the intermediate voltage, the circuit arrangement for driving the scanning lines is simplified. Since the voltage level is switched every one vertical scanning period, preferably every period of time longer than one vertical scanning period, the frequency of a signal supplied to the scanning lines drops. This arrangement therefore reduces power consumed by the circuit for driving the scanning lines in a voltage switching operation while also reducing power consumed when capacitances in the scanning lines and a driving circuit for the scanning lines are charged and discharged in response to the voltage switching operation.

Each of the particular scanning lines (the scanning lines relating to a pixel area in the display state) is supplied with the selection voltage during one of the two split halves of the horizontal scanning period. On the other hand, each of the particular data lines (the data lines relating to the image area in the display state) is supplied with the lighting voltage and the non-lighting voltage for substantially equal periods within the one horizontal scanning period, and the generation of cross-talk dependent on a display pattern is controlled.

Each of the data lines other than the particular data lines (the data lines relating to the pixel area in the non-display state) is supplied with the non- lighting voltage for one horizontal scanning period during which the particular scanning line is selected. In this case, the selection voltage applied to the scanning line is inverted in polarity every two or more horizontal scanning periods, and the non-lighting voltage applied to the data lines relating the pixel area in the non-display state is also switched every two or more horizontal scanning periods. The switching frequency of the voltage applied to the data line of the pixel in the pixel area in the non-display state is reduced. As a result, the power consumption involved in the switching operation can be lowered.

The lighting voltage here refers to the voltage of the data signal having a polarity opposite to the polarity of the selection voltage applied for the one half period of any given horizontal scanning period. The non-lighting voltage here refers to the voltage of the data signal having the same polarity as that of the selection voltage applied for the one half period of any given horizontal scanning period.

Preferably in the first aspect of the present invention, when one of the particular scanning lines is selected, the selected scanning line is supplied with the selection voltage for a second half of one horizontal scanning period, and when a subsequent scanning line is selected, the selected scanning line is supplied with the selection voltage for a first half of one horizontal scanning period, and the supply of the selection voltage alternates between during one half period and during the other half period, every one horizontal scanning period. If the supply of the selection voltage alternates between during one half period and during the other half period every one horizontal scanning period, the switching frequency of voltage supplied to the corresponding data line is reduced when each of an off display and an on display is consecutively formed on pixels in the display state in the direction of the data line. Accordingly, power consumption can be further lowered.

Preferably in the first aspect of the present invention, when the selection voltage is supplied during the second half period, the particular data line is supplied with the lighting voltage from a time point earlier than the end of the second half period by the period of time corresponding to a tonal gradation of a pixel at an intersection of the selected scanning line and the particular data line, till the end of the second half period. Further, the particular data line is supplied with the non-lighting voltage during the remaining time of the second half period. When the selection voltage is supplied during the first half period, the particular data line is supplied with the lighting voltage from the beginning of the first half period till a time point later than the beginning of the first half period by the duration corresponding to the tonal gradation of the pixel at the intersection of the selected scanning line and the particular data line. Further, the particular data line is supplied with the non-lighting voltage during the remaining time of the first half period.

When in this method, a so-called right-shifted modulation is performed to present a tonal gradation display at a pixel at an intersection of a particular scanning line and a particular data line, a left-shifted modulation is performed to present a tonal gradation display at a pixel at an intersection of a next selected particular scanning line and a data line. If an intermediate tonal gradation is presented on a pixel at an intersection of a particular scanning line and a particular data line, the frequency of switching between the lighting voltage and the non-lighting voltage, supplied to the particular data line, is reduced. Accordingly, the power consumed in the switching operation is even further reduced.

Considered strictly from an energy saving perspective, when the scanning line in the non-display state is selected in accordance with the first aspect of the present invention, each of the data lines is preferably supplied with a signal equivalent to the intermediate value between the positive side voltage and the negative side voltage. However, with this method, since the intermediate voltage has to be separately generated and, since, in addition to positive voltage and negative voltage, the circuit for driving the data line needs to select the intermediate voltage between the positive side voltage and the negative side voltage, the circuit can become complicated in construction.

In accordance with the first aspect of the present invention, for a duration of time during which the scanning lines other than the particular scanning lines are consecutively selected, the data lines are preferably supplied with a signal having a positive voltage portion and a negative voltage portion with respect to the intermediate value, the signal alternating between the positive voltage portion and the negative voltage portion with respect to the intermediate value every one or more horizontal scanning periods.

In this method, when the scanning lines in the non-display state are selected, each of the data lines is supplied with the signal having the positive voltage portion and the negative voltage portion with respect to the intermediate value, the signal alternating between the positive voltage portion and the negative voltage portion with respect to the intermediate value every one or more horizontal scanning periods. The root-mean-square value of the signal becomes substantially zero. This arrangement eliminates the need to generate and select the intermediate voltage. The arrangement of the circuit for driving the data lines becomes simple. The signal supplied to the data lines is inverted in polarity every horizontal scanning period, more preferably every period of time longer than one horizontal scanning period so that the level of the voltage supplied to the data line is switched with a longer period. The frequency of the voltage for driving the data lines is thus lowered. The power which is consumed by the circuit which drives the date lines in the voltage switching operation thereof is also reduced. The power which is consumed in the charging and discharging of capacitances present in circuits and wiring in response to the voltage switching operation is also reduced.

The polarity inversion period of the signal including the positive voltage portion and the negative voltage portion reaches the maximum length if it is approximately a fraction of the horizontal scanning period, and the fraction is determined by dividing the total number of scanning lines other than the particular scanning lines by an integer equal to two or larger. This arrangement reduces the power consumed by voltage switching operations and the power consumed in the charging and discharging of capacitances present in circuits and wiring along with the voltage switching operation.

To achieve the above object, in a second aspect of the present invention, a driving circuit of a display device drives a pixel which is arranged at each of intersections of a plurality of scanning lines and a plurality of data lines, in which a pixel at each of the intersections of particular scanning lines among the plurality of scanning lines and particular data lines among the plurality of data lines is set to be in a display state while the remaining pixels are set to be in a non-display state. The driving circuit can include a scanning line driving circuit and a data line driving circuit. The scanning line driving circuit selects the particular scanning lines, one line for every horizontal scanning period with a selection voltage supplied to the selected scanning line for one of the two split halves of one horizontal scanning period, inverts the polarity of the selection voltage with respect to an intermediate value between a lighting voltage and a non-lighting voltage, supplied to the data line, every two or more horizontal scanning periods, and supplies the scanning line other than the particular scanning lines with a non-selection voltage which is inverted in polarity with respect to the intermediate value every one or more vertical scanning periods.

The data line driving circuit supplies the particular data line with a lighting voltage in accordance with a content to be displayed on a pixel at an intersection of the selected scanning line and the particular data line, for a period, during which the selection voltage is supplied to the selected scanning line, within one horizontal scanning period for selecting one of the particular scanning lines, supplies the particular data line with the lighting voltage and the non-lighting voltage for substantially equal periods within the one horizontal scanning period for the selected scanning line, and supplies the data lines other than the particular data lines with the non-lighting voltage for a period during which the particular scanning lines are consecutively selected in response to the polarity of the selection voltage supplied to the selected scanning lines, wherein the polarity of the non-lighting voltage is inverted in synchronization with the period of polarity inversion of the selection voltage. As in the first aspect of the present invention, this arrangement simplifies the circuit arrangement of the circuit for driving the scanning lines. Since the voltage supplied to the data line for the pixel area in the non-display state is switched every two or more horizontal scanning periods, the power involved in the voltage switching is reduced. Also, the generation of cross-talk due to a display pattern is also reduced.

Preferably in the second aspect of the present invention, when one of the particular scanning lines is selected, the scanning line driving circuit supplies the selected scanning line with the selection voltage for a second half of one horizontal scanning period. When a subsequent particular scanning line is selected, the scanning line driving circuit supplies the selected scanning line with the selection voltage for a first half of one horizontal scanning period, and the supply of the selection voltage alternates between during one half period and during the other half period, every one horizontal scanning period. When each of an off display and an on display is consecutively formed on pixels in the display state in the direction of the data line in this arrangement, the frequency of switching the voltage supplied to the corresponding data lines can be reduced. Accordingly, power consumption is reduced.

Preferably in the second aspect of the present invention, when the selection voltage is supplied during the second half period, the data line driving circuit supplies the particular data line with the lighting voltage from a time point earlier than the end of the second half period by the period of time corresponding to a tonal gradation of a pixel at an intersection of the selected scanning line and the particular data line, till the end of the second half period, and is supplied with the non-lighting voltage during the remaining time of the second half period, and when the selection voltage is supplied during the first half period, the data line driving circuit supplies the particular data line with the lighting voltage from the beginning of the first half period till a time point later than the beginning of the first half period by the period of time corresponding to the tonal gradation of the pixel at the intersection of the selected scanning line and the particular data line, and is supplied with the non-lighting voltage during the remaining time of the first half period. If an intermediate tonal gradation is presented on a pixel at an intersection of a particular scanning line and a particular data line, the frequency of switching between the lighting voltage and the non-lighting voltage, supplied to the particular data line, is reduced. Accordingly, the power consumed in the switching operation is even further reduced.

Preferably in the second aspect of the present invention, for a duration of time during which the scanning lines other than the particular scanning lines are consecutively selected, the data line driving circuit supplies the data line with a signal having a positive voltage portion and a negative voltage portion with respect to the intermediate value, the signal alternating between the positive voltage portion and the negative voltage portion with respect to the intermediate value every one or more horizontal scanning periods. This arrangement simplifies the circuit arrangement of the circuit for driving the scanning lines. This arrangement reduces the power consumed by voltage switching operations and the power consumed in the charging and discharging of capacitances present in circuits and wiring along with the voltage switching operation.

The polarity inversion period of the signal includes the positive voltage portion and the negative voltage portion reaches the maximum length if it is approximately a fraction of the horizontal scanning period. The fraction is determined by dividing the total number of the scanning lines other than the particular scanning lines by an integer equal to two or larger. This arrangement reduces the power consumed by voltage switching operations and the power consumed in the charging and discharging of capacitances present in circuits and wiring along with the voltage switching operation.

To achieve the above object, in a third aspect of the present invention, a display device drives pixels arranged at each intersection of a plurality of scanning lines and a plurality of data lines, in which a pixel at each of the intersections of particular scanning lines among the plurality of scanning lines and of particular data lines among the plurality of data lines is set to be in a display state while the remaining pixels are set to be in a non-display state. The display device can include a scanning line driving circuit and a data line driving circuit. The scanning line driving circuit selects the particular scanning lines, one line for every horizontal scanning period with a selection voltage supplied to the selected scanning line for one of the two split halves of one horizontal scanning period, inverts the polarity of the selection voltage with respect to an intermediate value between a lighting voltage and a non- lighting voltage, supplied to the data line, every two or more horizontal scanning periods, and supplies the scanning line other than the particular scanning lines with a non-selection voltage which is inverted in polarity with respect to the intermediate value every one or more vertical scanning periods.

The data line driving circuit supplies the particular data line with a lighting voltage in accordance with a content to be displayed on a pixel at an intersection of the selected scanning line and the particular data line, for a period, during which the selection voltage is supplied to the selected scanning line, within one horizontal scanning period for selecting one of the particular scanning lines, supplies the particular data lines with the lighting voltage and the non-lighting voltage for substantially equal periods within the one horizontal scanning period for the selected scanning line, and supplies the data line other than the particular data lines with the non-lighting voltage for a period during which the particular scanning lines are consecutively selected in response to the polarity of the selection voltage supplied to the selected scanning lines, wherein the polarity of the non-lighting voltage is inverted in synchronization with the period of polarity inversion of the selection voltage. As in the first and second aspects of the present invention, this arrangement allows the circuit for driving the scanning lines to be simplified. Since the voltage supplied to the data line for the pixel area in the non-display state is switched every two or more horizontal scanning periods, the power involved in the voltage switching is reduced. The generation of cross-talk due to a display pattern is also reduced.

Preferably in the third aspect of the present invention, the pixel can include a switching element and a capacitive element composed of an electro-optical material. When a single scanning line is supplied with the selection voltage, the switching element of the pixel assigned to the selected scanning line becomes conductive, and writing is performed on the capacitive element of the switching element in response to a lighting voltage supplied to the corresponding data line. Since the switching element electrically isolates a selected pixel from non-selected pixels in this arrangement, contrast and response of the display screen become excellent, and a high-definition display is thus presented.

Preferably, the switching element is a two-terminal switching element, and the pixel is formed of the two-terminal switching element and the capacitive element connected in series between the scanning line and the data line. Although a three-terminal switching element such as a transistor can be employed in the third aspect of the present invention, the scanning line and the data line need to be crossed on one substrate, so such an arrangement not only increases the chance of short-circuits, but also complicates the manufacturing process. In contrast, the two- terminal switching element has an advantage that theoretically no short-circuits occur.

Preferably, the two-terminal switching element has a conductor- insulator-conductor structure connected to either the scanning line or the data line. Any of the conductors can be used as a scanning line or a data line. Since the insulator may be formed by oxidizing the conductor itself, the manufacturing process of the device is simplified.

To achieve the above object, electronic equipment includes the above-referenced display device. Power saving is performed with the generation of cross-talk due to a display pattern reduced.

BRIEF DESCRIPTION OF THE DRAWINGS

The invention will be described with reference to the accompanying drawings, in which like elements are referred to with like numbers, and in which.

DETAILED DESCRIPTION OF PREFERRED EMBODIMENTS

Figure 1:
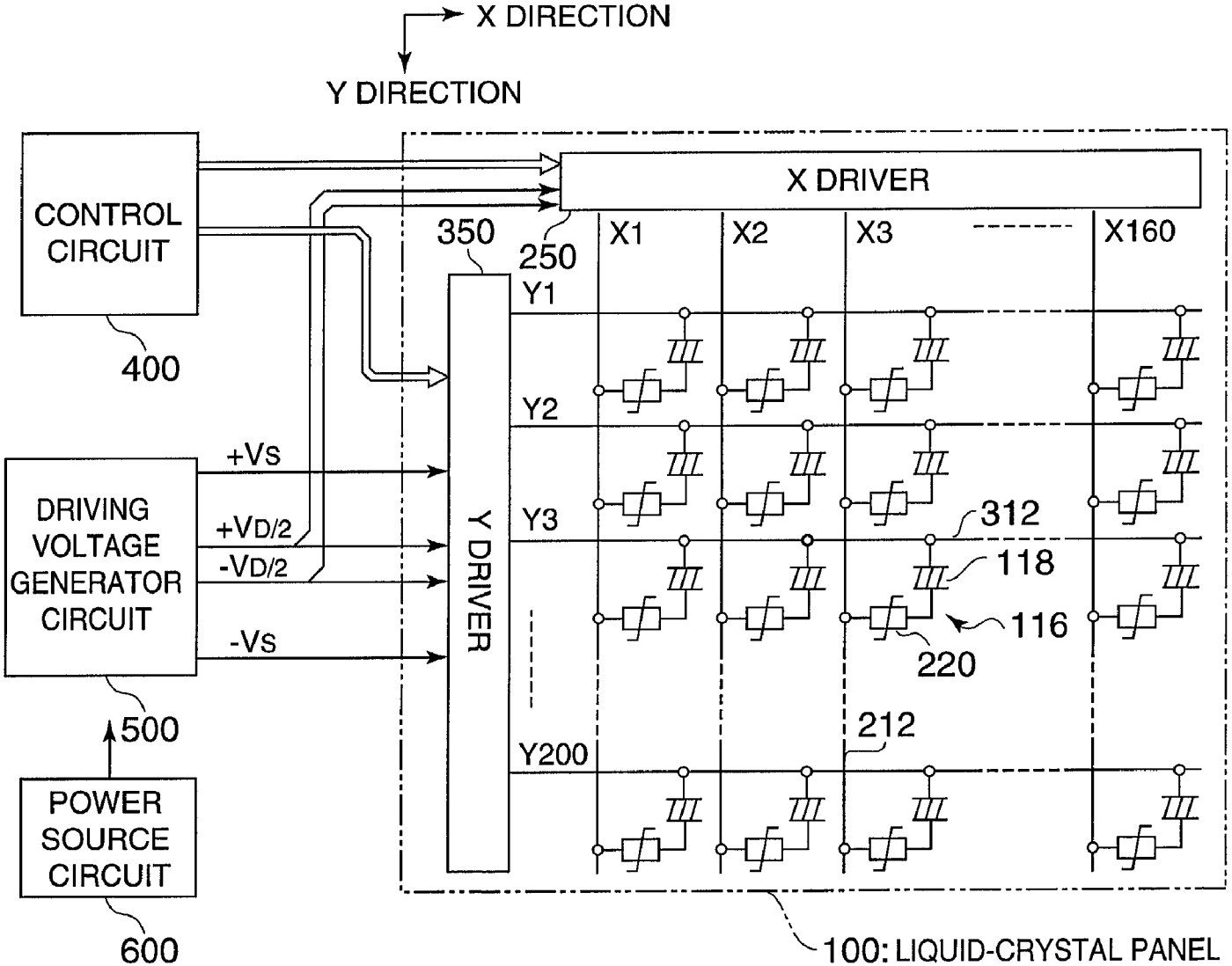
FIG. 1 is an exemplary block diagram showing the electrical construction of a display device of a first embodiment of the present invention.

The embodiments of the present invention will now be discussed, referring to the drawings.

First, the electrical construction of a liquid crystal panel 100 of a first embodiment of the present invention will be discussed. FIG. 1 is an exemplary block diagram showing the electrical construction of the liquid crystal panel 100. As shown, the liquid crystal panel 100 can include a plurality of data lines (segment electrodes) 212 extending in the direction of columns (in the Y direction), a plurality of scanning lines (common electrodes) 312 extending in the direction of rows (in the X direction), and a pixel 116 arranged at each intersection of the data lines 212 and the scanning lines 312. Each pixel 116 includes a serial connection of a liquid-crystal capacitor 118 and a TFD (Thin-Film Diode) 220 as a switching element. As discussed in greater detail below, the liquid-crystal capacitor 118 is constructed of a liquid crystal as one example of the electro-optical material interposed between the scanning line 312 functioning as a counter electrode and a pixel electrode. In this embodiment, for simplicity of explanation, the total number of the scanning lines 312 is 200, the total number of the data lines 212 is 160, and a display device of a matrix of 200 rows by 160 columns is considered. However, it is to be understood that the present invention is not limited to this arrangement.

A Y driver 350, typically referred to as a scanning line driving circuit, supplies scanning lines 312 respectively with scanning signals Y1, Y2, . . . m Y200. The Y driver 350 of this embodiment selects one of the scanning lines 312 for each horizontal scanning period, supplies the selected scanning line 312 with the selection voltage for a second half of a selection period, and supplies the scanning line 312 with a non-selection voltage (a hold voltage) during a first half of the selection period and during a non-selection period (a hold period).

An X driver 250, typically referred to as a data line driving circuit, supplies pixels 116 corresponding to the scanning line 312 selected by the Y driver 350 with data signals X1, X2, . . . , X160 through the corresponding data lines 212 in accordance with a display content. The construction of the X driver 250 and the Y driver 350 will be discussed in detail later.

A control circuit 400 supplies the X driver 250 and the Y driver 350 with a variety of control signals and clock signals to control the X driver 250 and the Y driver 350. A driving voltage generator circuit 500 generates voltages of $\pm V_D/2$, any of which serves as the data signal and the non-selection voltage of the scanning signal, and voltages of $\pm V_S$ serving as the selection voltage of the scanning signal. Although the data signal and the non-selection voltage of the scanning signal are the same voltage, the data signal and the non-selection voltage can be set to be different. A power source circuit 600 feeds power to the control circuit 400, and the driving voltage generator circuit 500.

In this embodiment, the polarities of the voltages supplied to the scanning line 312 and the data line 212 are determined with respect to the intermediate voltage between the voltages $\pm V_D/2$, applied to the data line 212. A voltage above the intermediate voltage is regarded as positive and a voltage below the intermediate voltage is regarded as negative.

Figure 2:
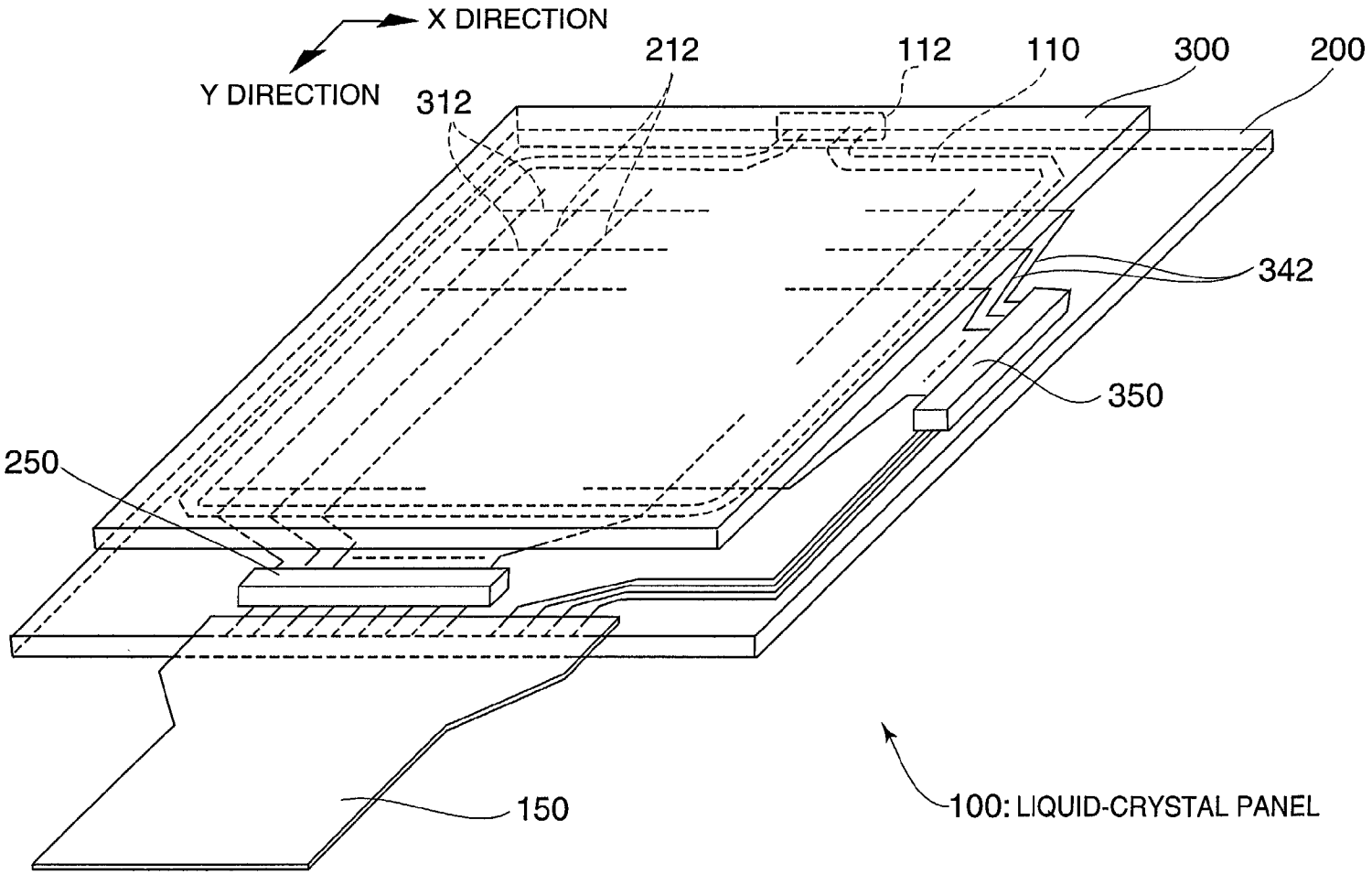
FIG. 2 is a perspective view showing a liquid-crystal panel in the display device.
Figure 3:
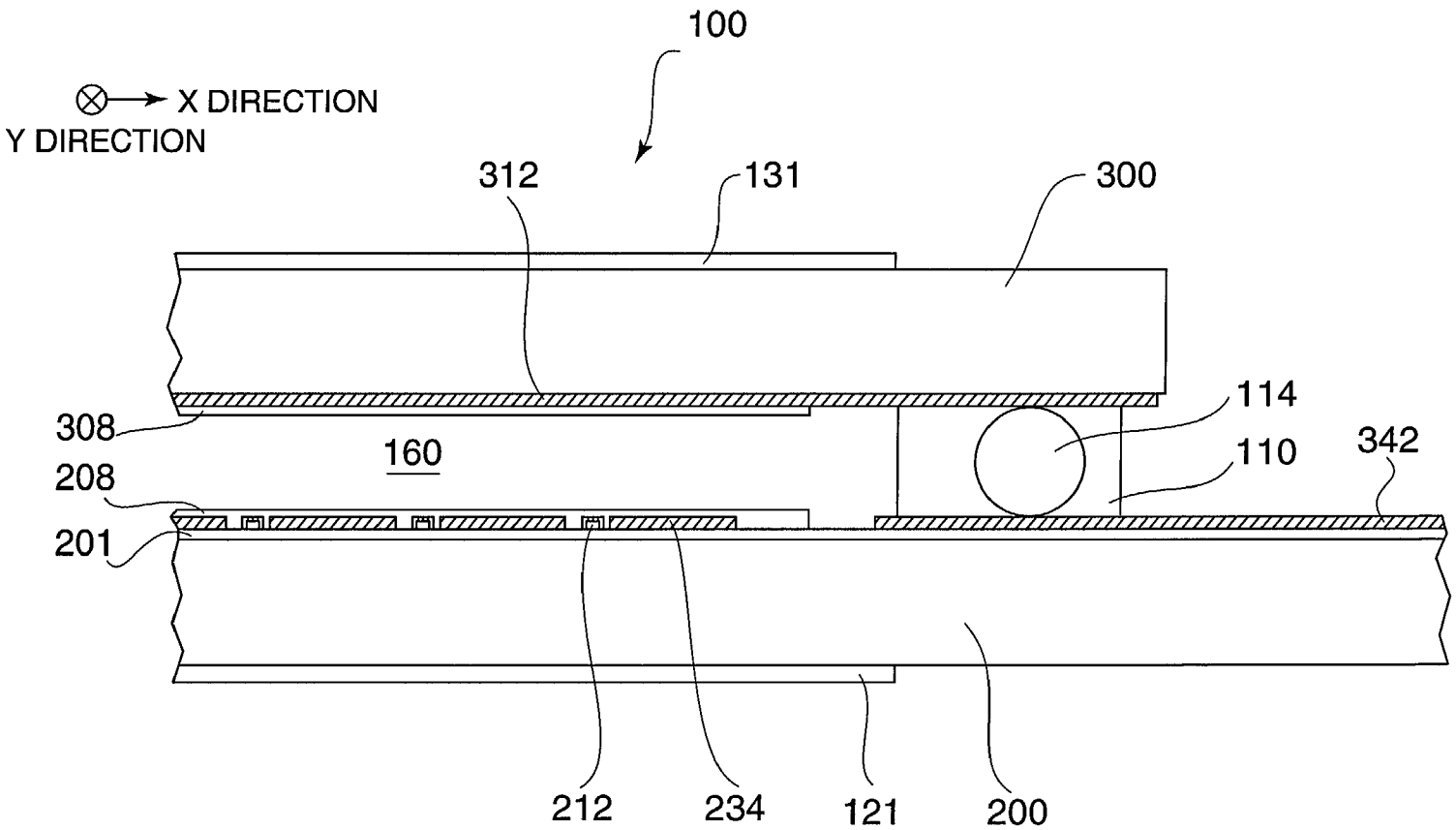
FIG. 3 is a sectional view of the liquid-crystal panel taken along a line running in the X direction.

The mechanical construction of the liquid crystal panel 100 of the display device of this embodiment will now discussed. FIG. 2 is a perspective view generally showing the construction of the liquid crystal panel 100. FIG. 3 is a cross- sectional view partially showing the liquid crystal panel 100, taken along a line running in the X direction.

As shown, the liquid crystal panel 100 is composed of a counter substrate 300 located on the viewer side and an element substrate 200 located behind the counter substrate 300, the substrates being aligned and bonded to one another with a constant gap maintained therebetween by means of a sealing material 110 into which electrically conductive particles (electrically conductive members) 114 that also serve as spacers are mixed. A TN (Twisted Nematic) type liquid crystal 160, for example, is encapsulated into the gap. The sealing material 110 is formed in a frame configuration on one of the substrates, such that it extends along the inside edge of the counter substrate 300, as shown in FIG. 2. To introduce the liquid crystal 160, part of the sealing material 110 is opened. After encapsulating the liquid crystal, the opening is closed with a sealant 112.

Arranged on the counter surface of the counter substrate 300 is an alignment layer 308 in addition to the scanning line 312 extending in the direction of rows (in the X direction). The alignment layer 308 has been subjected to a rubbing process. Referring to FIG. 3, the scanning line 312 formed on the counter substrate 300 is connected via an electrically conductive particle 114 in a sealing material 110 to the end of a wiring 342 formed on the element substrate 200, said wiring 342 having a one-to-one correspondence with each scanning line 312. Specifically, the scanning lines 312 formed on the counter substrate 300 are routed out to the element substrate 200 via the electrically conductive particles 114 and the wirings 342. A polarizer 131 (not shown in FIG. 2) is arranged on the outer surface (the surface closest to the viewer) of the counter substrate 300. The absorption axis of the polarizer 131 corresponds to the direction of the rubbing process of the alignment layer 308.

Arranged on the inner surface of the element substrate 200 is an alignment layer 208 in addition to the rectangular pixel electrode 234 arranged adjacent to the data line 212 extending in the Y direction (the direction of columns). The alignment layer 208 has been subjected to a rubbing process in the prescribed direction. A polarizer 121 (not shown in FIG. 2) is arranged on the outer surface (opposite to the viewer side) of the element substrate 200. The absorption axis of the polarizer 121 corresponds to the direction of the rubbing processon the alignment layer 208. Although a backlight unit is arranged external to the element substrate 200 to direct uniform light rays, the backlight unit is not shown because the backlight unit is not directly related to the present invention.

The area outside the display area will now be described. Referring to FIG. 2, a Y driver 350 for driving the scanning lines 312 and an X driver 250 for driving the data lines 212 are respectively mounted on two peripheral portions of the element substrate 200 extending beyond the edges of the counter substrate 300 using a COG (Chip On Glass) technique. In this manner, the Y driver 350 supplies the scanning lines 312 with the scanning signal via the wirings 342 and the electrically conductive particles 114, while the X driver 250 directly supplies the data lines 212 with the data signal.

An FPC (Flexible Printed Circuit) board 150 is bonded to an area of the element substrate 200, external to the mounting location of the X driver 250, and supplies the Y driver 350 and the X driver 250 with a variety of control signals and voltage signals from the control circuit 400 and the driving voltage generator circuit 500 (see FIG. 1 for these circuits).

The X driver 250 and the Y driver 350 shown in FIG. 1 are respectively above and on the left of the liquid crystal panel 100 in a layout different than that shown in FIG. 2. This layout is for convenience only for the discussion of the electric construction. Instead of respectively chip on glass (COG) mounting the X driver 250 and the Y driver 350 on the element substrate 200, a TCP (Tape Carrier Package) having each driver mounted thereon may be electrically and mechanically connected to the substrate through an anisotropically conductive film arranged at a predetermined location on the substrate using the TAB (Tape Automated Bonding) technique.

Figure 4:
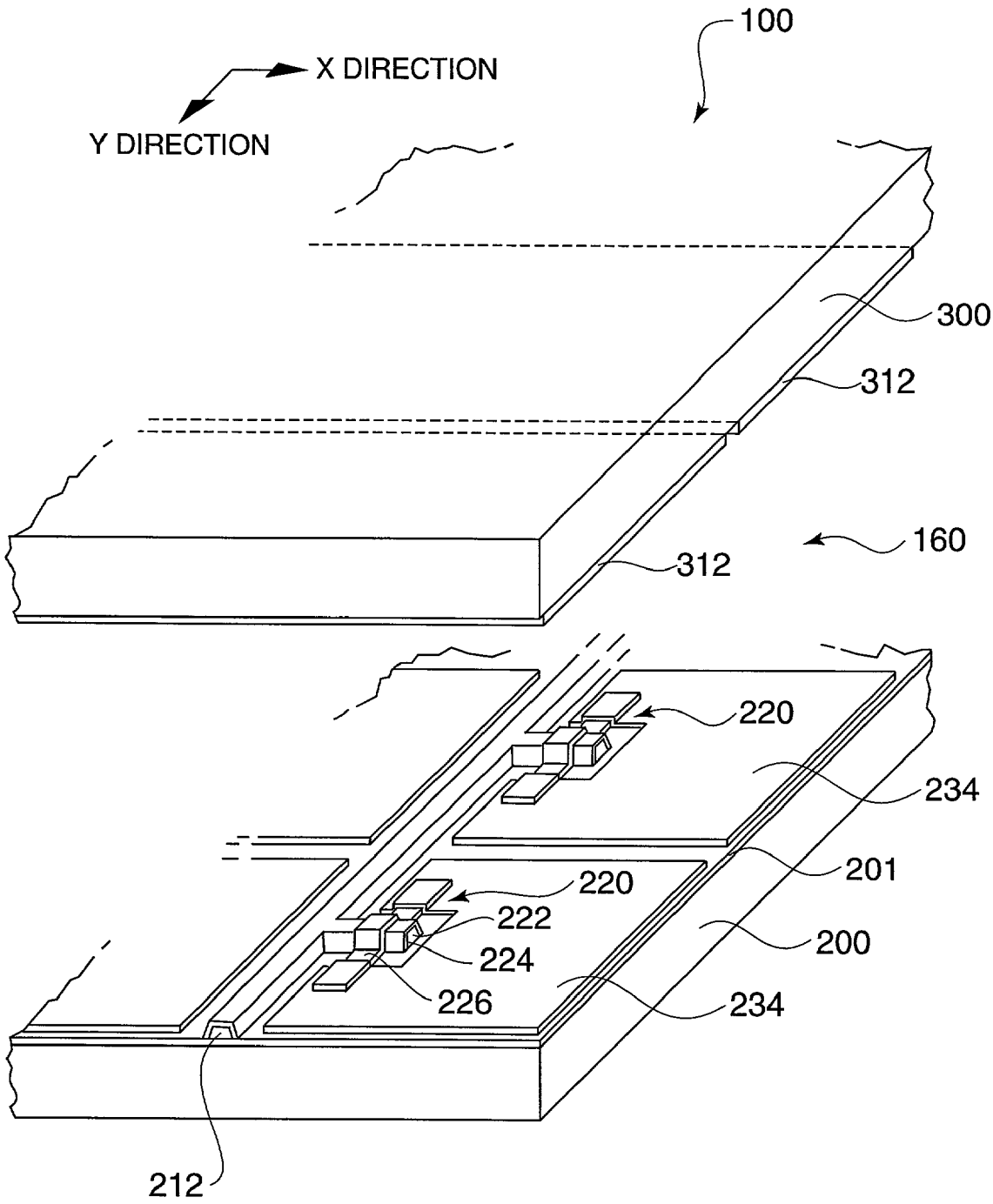
FIG. 4 is a perspective view, partly cut away, of a major construction of the liquid-crystal panel.

The detailed construction of a pixel 116 in the liquid-crystal panel 100 will now be discussed. FIG. 4 is a partial perspective view of the pixel 116. For simplicity, the alignment layers 208 and 308 and the polarizers 121 and 131 shown in FIG. 3 are not shown.

Referring to FIG. 4, a matrix of rectangular pixel electrodes 234, fabricated of an electrically conductive, transparent member such as ITO (Indium Tin Oxide), is arranged on the inner surface of the element substrate 200, and 200 pixel electrodes 234 in the same column are commonly connected to a single data line 212 via respective TFDs 220. The TFD 220 is fabricated of tantalum or a tantalum-based alloy, if viewed from the substrate, and includes a first conductor 222 that is branched off from the data line 212 in a T-shaped configuration, an insulator 224 that is formed by anodically oxidizing the first conductor 222, and a second conductor 226 fabricated of chromium, or the like. The TFD 220 thus has a sandwich structure of conductor- insulator-conductor. The TFD 220 therefore has diode switching characteristics that are non-linear current-voltage curves in both positive and negative directions.

The insulator 201 formed on the top surface of the element substrate 200 has transparent and insulating properties. The insulator 201 is intended to prevent the first conductor 222 from peeling off in a heat treatment subsequent to the deposition of the second conductor 226, and to prevent impurities from diffusing into the first conductor 222. When the peeling of the first conductor 222 and the diffusion of the impurities are not problematic, the insulator 201 may be dispensed with.

The scanning line 312, fabricated of the ITO, is formed on the inner surface of the counter substrate 300 and extends in a direction perpendicular to the data line 212. The scanning line 312 is opposed to the pixel electrode 234. In this arrangement, the scanning line 312 serves as a counter electrode against the pixel electrode 234. Referring to FIG. 1, the liquid crystal layer 118 is thus constructed of the scanning line 312, the pixel electrode 234, and the liquid crystal 160 interposed between the scanning line 312 and the pixel electrode 234, at each intersection of the data line 212 and the scanning line 312.

Depending on the liquid-crystal panel 100 application, a color filter in a striped configuration, a mosaic configuration or a delta configuration is arranged on the counter substrate 300, whereas a black matrix can be arranged in other areas to prevent color mixing between pixels and to block light.

Figure 23:
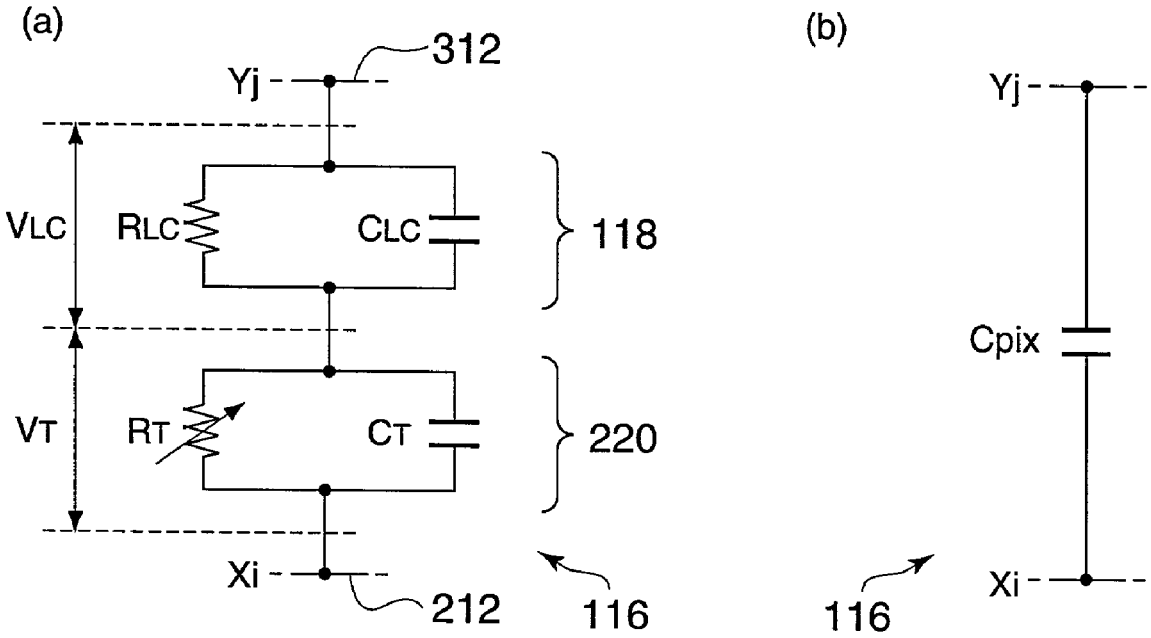
FIG. 23(*a*) and FIG. 23(*b*) show equivalent circuits of pixels in the display device of each embodiment.

A single pixel 116 thus constructed is shown in an equivalent circuit in FIG. 23(*a*). The pixel 116 at the intersection of the scanning line 312 at a j-th row (j is an integer within a range of $1 \leqq j \leqq 200$) and the data line 212 at an i-th column (i is an integer within a range of $1 \leqq i \leqq 160$) is represented by a serial circuit of a TFD 220 and a liquid-crystal capacitor 118. The TFD 220 is a parallel circuit of a resistor $R_T$ and a capacitor $C_T$, and a liquid-crystal capacitor 118 is a parallel circuit of a resistor $R_{LC}$ and a capacitor $C_{LC}$.

Figure 24:
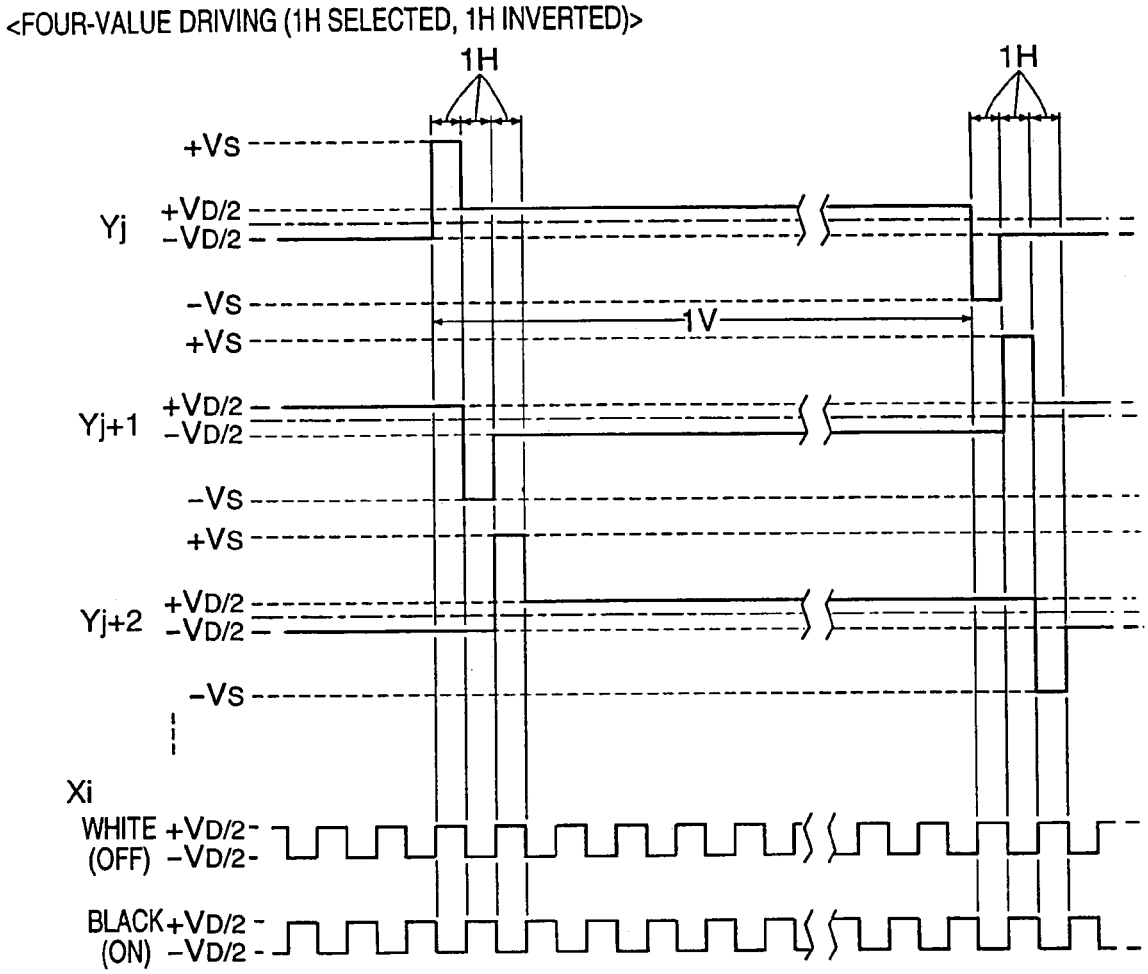
FIG. 24 RELATED ART
FIG. 24 is a waveform diagram of a scanning signal Yj and a data signal Xi in a four-value driving method (with 1H selected)

A four-value driving method (1H selected, 1H inverted) as a typical driving method will now be discussed. FIG. 24 shows waveforms of a scanning signal Yj and a data signal Xi applied to the pixel 116 at the j-th row and the i-th column in the four-value driving method (1H selected and 1H inverted). In this driving method, as the scanning signal Yj, a selection voltage +Vs is supplied for one horizontal scanning period 1H, and then, a non-selection voltage $+V_D/2$ is applied and held for a hold period. After one vertical scanning period (one frame) 2V has elapsed from a preceding selection, a selection voltage $-V_S$ is supplied and a non-selection voltage $-V_D/2$ is applied and held for a hold period. This series of steps is repeated while one of voltages $\pm V_D/2$ is supplied as the data signal Xi. When the selection voltage of $+V_S$ as a scanning signal Yj is applied to one scanning line, the selection voltage $-V_S$ as a scanning signal Yj+1 is applied to the next scanning line. In this way, the polarity of the selection voltage is inverted every horizontal scanning period 1H.

In the four-value driving method (with the 1H selected and 1H inverted), the voltage of the data signal Xi is $-V_D/2$ to present an ON display (a black display in the normally white mode, for example) on the pixel 116 when the selection voltage $+V_S$ is applied and is $+V_D/2$ to present an off display (a white display in the normally white mode) on the pixel 116. When the selection voltage $-V_S$ is applied, the voltage of the data signal Xi is $+V_D/2$ to present an ON display on the pixel 116, and is $-V_D/2$ to present an OFF display on the pixel 116.

Figure 25:
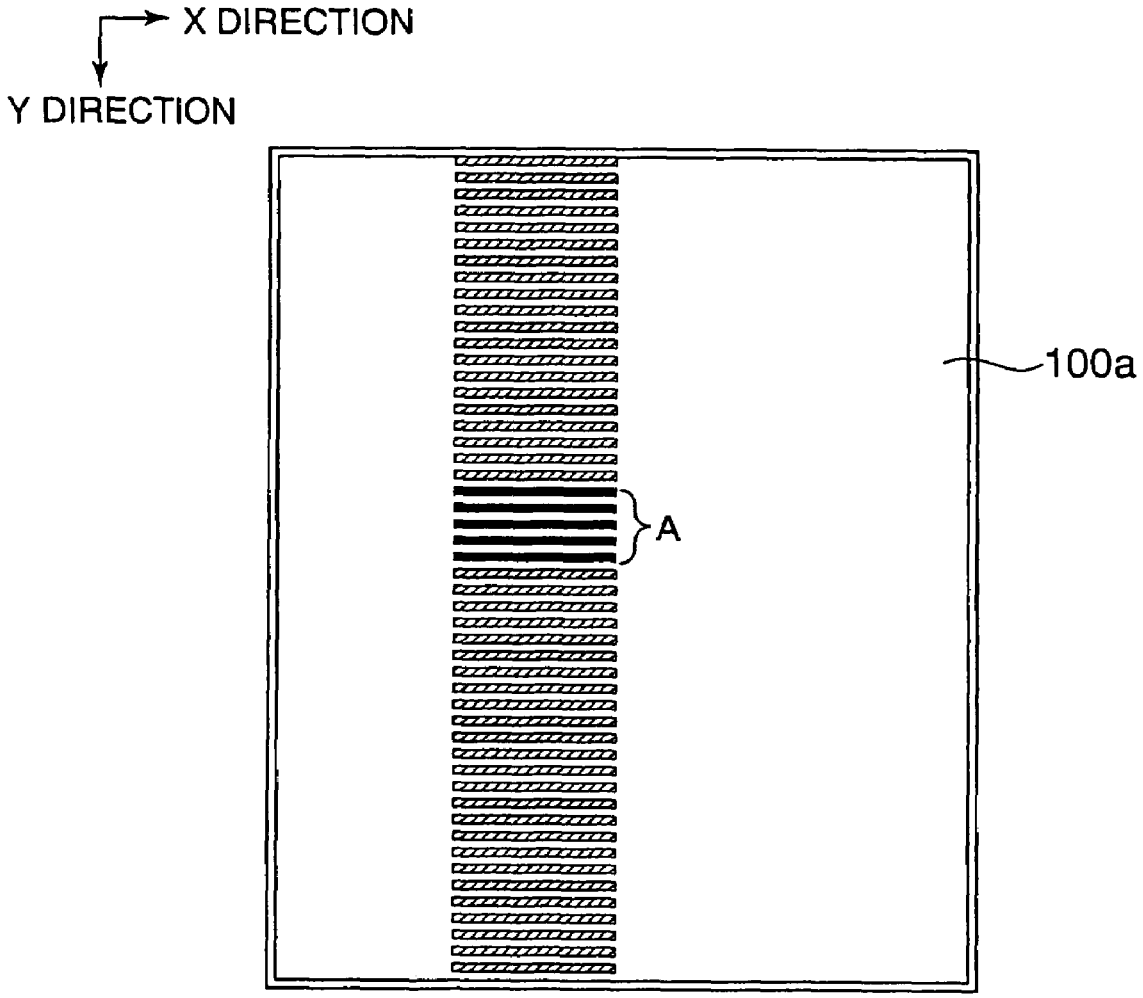
FIG. 25 RELATED ART
FIG. 25 shows a fault in a display.

Referring to FIG. 25, the four-value driving method (with the 1H selection period and 1H level-inverted period) is known for cross-talk, namely, a white display associated with a density difference, taking place in an area A in the Y direction in a display screen 100*a* when a zebra pattern of a white display and a black display alternating every row appears in the area A with the remaining area simply presenting a white area.

A reason why the cross-talk can occur is that when the zebra pattern is presented in the area A, the switching period of the voltages $\pm V_D/2$ of the data signal supplied to the data line in the area A coincides with the inversion period of the scanning signal. The voltage of the data signal is thus fixed to one of the voltages $\pm V_D/2$ for a period throughout which the scanning line in the area A is selected. If viewed from the pixel in the area adjacent to the area A in the Y direction, the voltage is fixed to the one voltage during a portion of the hold period. The selection voltages on the mutually adjacent scanning lines are opposite to each other in polarity. In an area adjacent to the area A in the Y direction, the root-mean-square value of the voltage applied for a portion of the hold period becomes different between the pixel 116 on an odd row and the pixel 116 on an odd row. As a result, in the area adjacent to the area A in the Y direction, a density difference takes place between the pixel 116 on the odd row and the pixel 116 on the even row. The above-mentioned cross-talk thus occurs.

Figure 26:
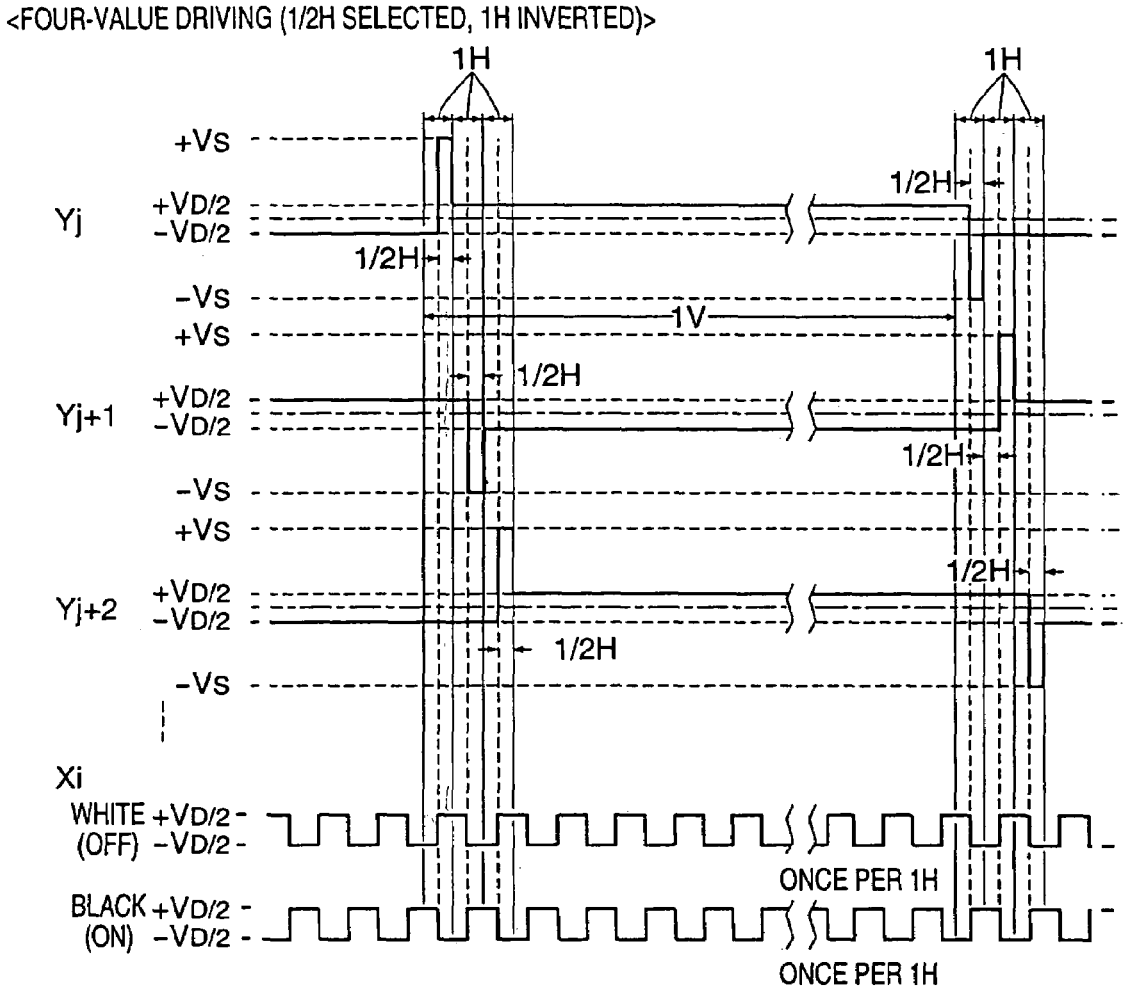
FIG. 26 RELATED ART
FIG. 26 is a waveform diagram of a scanning signal Yj and a data signal Xi in a four-value driving method (with ½H selected)

To resolve the cross-talk problem, the four-value driving method (with a ½H selected and a 1H inverted) can be used. Referring to FIG. 26, one horizontal scanning period 1H is divided into a first half and a second half in the four- value driving method (with the 1H selected and the 1H inverted). The selection voltage is supplied to the scanning line for the second half ½H, while the ratio of applying the voltage $-V_D/2$ and the voltage $+V_D/2$ to the data signal during one horizontal scanning period 1H is set to be 50%. In the four-value driving method (with the ½H selected and the 1H inverted), each of the application periods of the voltage $-V_D/2$ and of the voltage $+V_D/2$ is half the one horizontal scanning period in the data signal Xi if any pattern is presented. Accordingly, the generation of the above-mentioned cross-talk is thus prevented.

Since a total number of the scanning lines 312 is 200 in the display device of this embodiment, the hold period (the non-selection period) in one vertical scanning period 1V is 199H, which is 199 times the one horizontal scanning period 1H. During the hold period, the TFD 200 remains turned off. The resistance $R_T$ is thus sufficiently large, and the resistance $R_{LC}$ of the liquid-crystal layer 118 is also large regardless of whether or not the TFD 200 is turned off. The equivalent circuit of the pixel 116 during the hold period is expressed by a capacitance $C_{PIX}$ composed of the capacitor $C_T$ and the capacitor $C_{LC}$ connected in series as shown in FIG. 23(*b*). The capacitance $C_{PIX}$ is $(C_T \times C_{LC})/(C_T + C_{LC})$.

Figure 5:
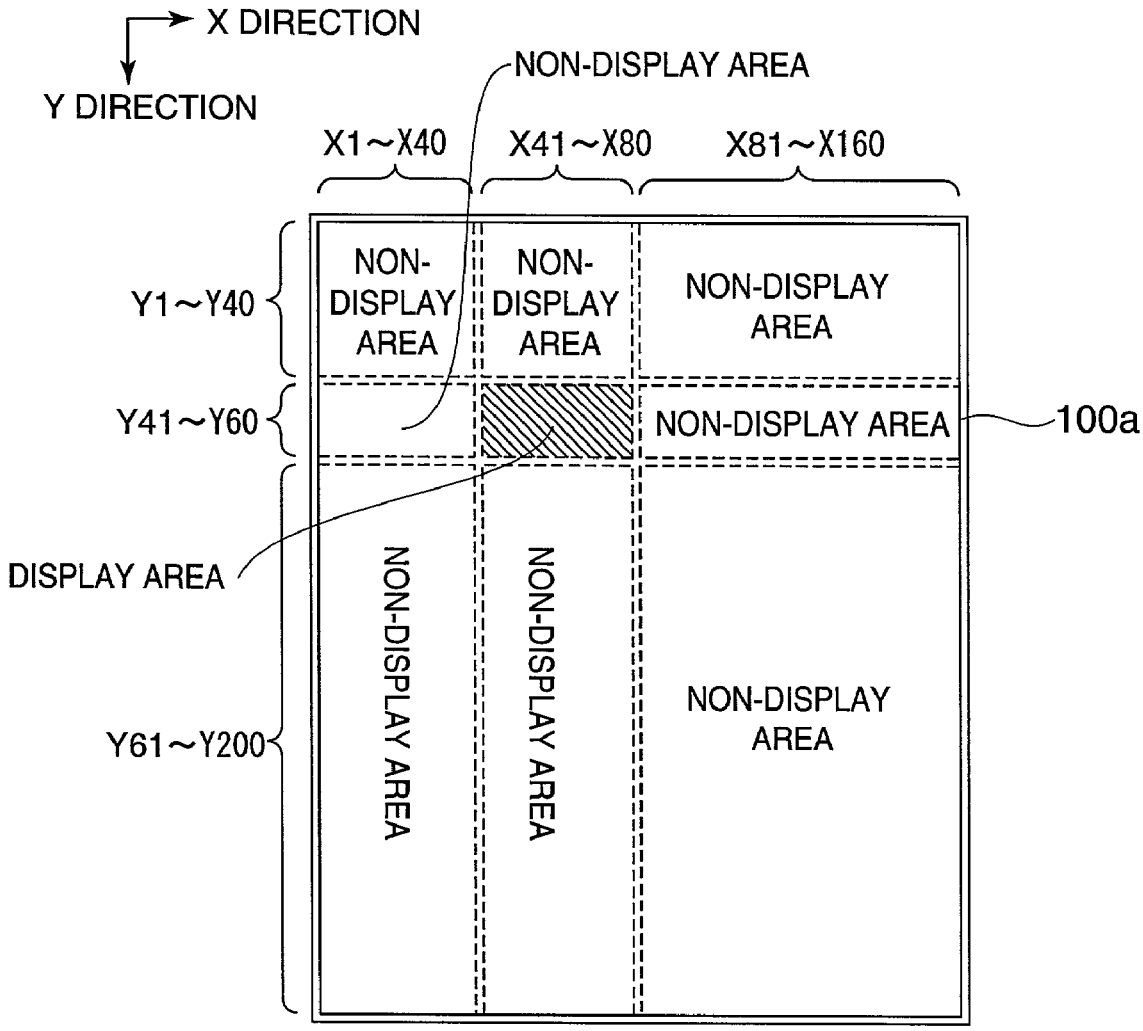
FIG. 5 shows a partial display in the liquid-crystal panel.

Referring to FIG. 5, the liquid-crystal panel 100 presents a display area formed of pixels at intersections of the 41 st-row through the 60th-row scanning lines 312 from the top of the screen and the 41 st-column through the 80th-column data lines 212, while placing the remaining pixels in a non-display state.

In a simple way, first, the scanning lines 312 are sequentially selected one by one, and when the selected scanning line falls within the display area, the scanning signal including the selection voltage is supplied to the selected scanning line. When the selected scanning line falls within the non-display area, a zero voltage, which is the intermediate voltage between the data voltages of $\pm V_D/2$, is supplied to the scanning line. Second, the data signals X41 through X80 falling within the display area are those corresponding to the content to be displayed on the display area when the scanning lines 312 of the 41 st row through the 60th row are selected, and are zero voltage when the scanning lines 312 on the first row through the 40th row and the 61 st row through 200th row are selected. Third, the data signals X1 through X40 and X81 through X160 falling within the non-display area correspond to an off (white) display when the scanning lines 312 on the 41 st row through the 60th row are selected, and are zero voltage when the scanning lines 312 on the first row through the 40th row and the 61st row through the 200th row are selected.

Figure 27:
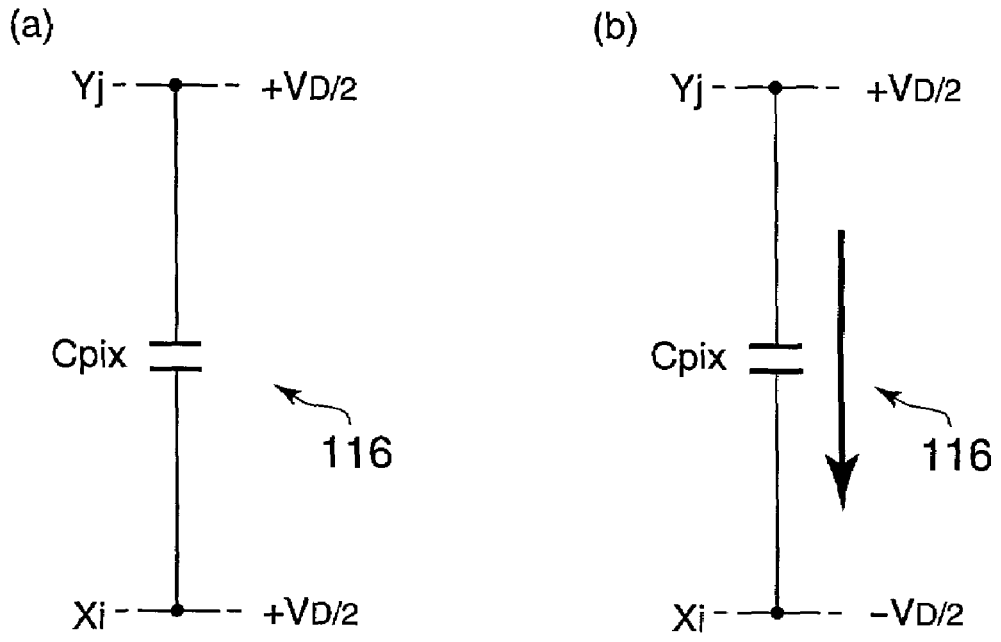
FIG. 27(*a*) and FIG. 27(*b*) explain power consumption in the voltage switching of the data signal Xi during a non-selection period (a hold period)

However, in this method, the pixel capacitor $C_{LC}$ in the non-display area is subject to frequent charging and discharging for a duration during which a scanning line 312 in the display area is selected. Power consumption is thus not reduced as expected. This is described below in greater detail. For example, as shown in FIG. 27, when the non-selection voltage of the scanning signal Yj to the scanning line 312 belonging to the display area (here referring to scanning signals Y41 through Y60 respectively supplied to the scanning lines at the 41 st row through the 60th row) is kept to $+V_D/2$, the data signal Xi to the data line 212 assigned to the non- display area (here referring to data signals X1 through X40 and X81 through X160 respectively supplied to the data lines on the first row through the 40th row and on the 81 st row through the 160th row) corresponds to an off display, and the data signal is alternately switched between the voltage $-V_D/2$ and the voltage $+V_D/2$ every half the horizontal scanning period 1H (½H). The pixel capacitor $C_{LC}$ is charged and discharged twice a horizontal scanning period 1H.

In this method, for a duration during which the scanning line belonging to the non-display area is scanned (selected), a single pixel 116 even in the non-display area is supplied with charge of $C_{PIX} \cdot V_D$ at the voltage switching during the hold (selection) period and the capacitive load of the pixel 116 thus consumes power.

Furthermore, besides the selection voltages $\gamma V_S$ and the data voltages $\pm V_D/2$ also serving as the non-selection voltages, this method requires the generation and the selection of the zero voltage. The construction of the driving voltage generator circuit 500, the X driver 250, and the Y driver 350 becomes complex.

First, the display device of this embodiment sequentially selects the scanning lines 312 one by one, and supplies the selected scanning line with the scanning signal containing the selection voltage when the selected scanning line falls within the display area, and supplies the selected scanning line with the non-selection voltage when the selected scanning line falls within the non-display area. The polarity of the scanning signal is inverted every one or more vertical scanning periods. Second, for the duration during which the scanning line 312 falling within the display area is selected, the polarity inversion period of the selection voltage is set to be two or more horizontal scanning periods. The data signal supplied to the data line 212 within the non-display area is fixed to a voltage corresponding to an off (white) display throughout one horizontal scanning period to reduce the voltage switching frequency of the data signal for the non-display area. Third, for duration during which the scanning line 312 falling within the non-display area is selected, the polarity of the data signal for the data line 212 within the non-display area is switched for a predetermined period so that power consumed by the pixels within the non-display area is reduced. The circuit for performing such a driving method will now be discussed.

Figure 7:
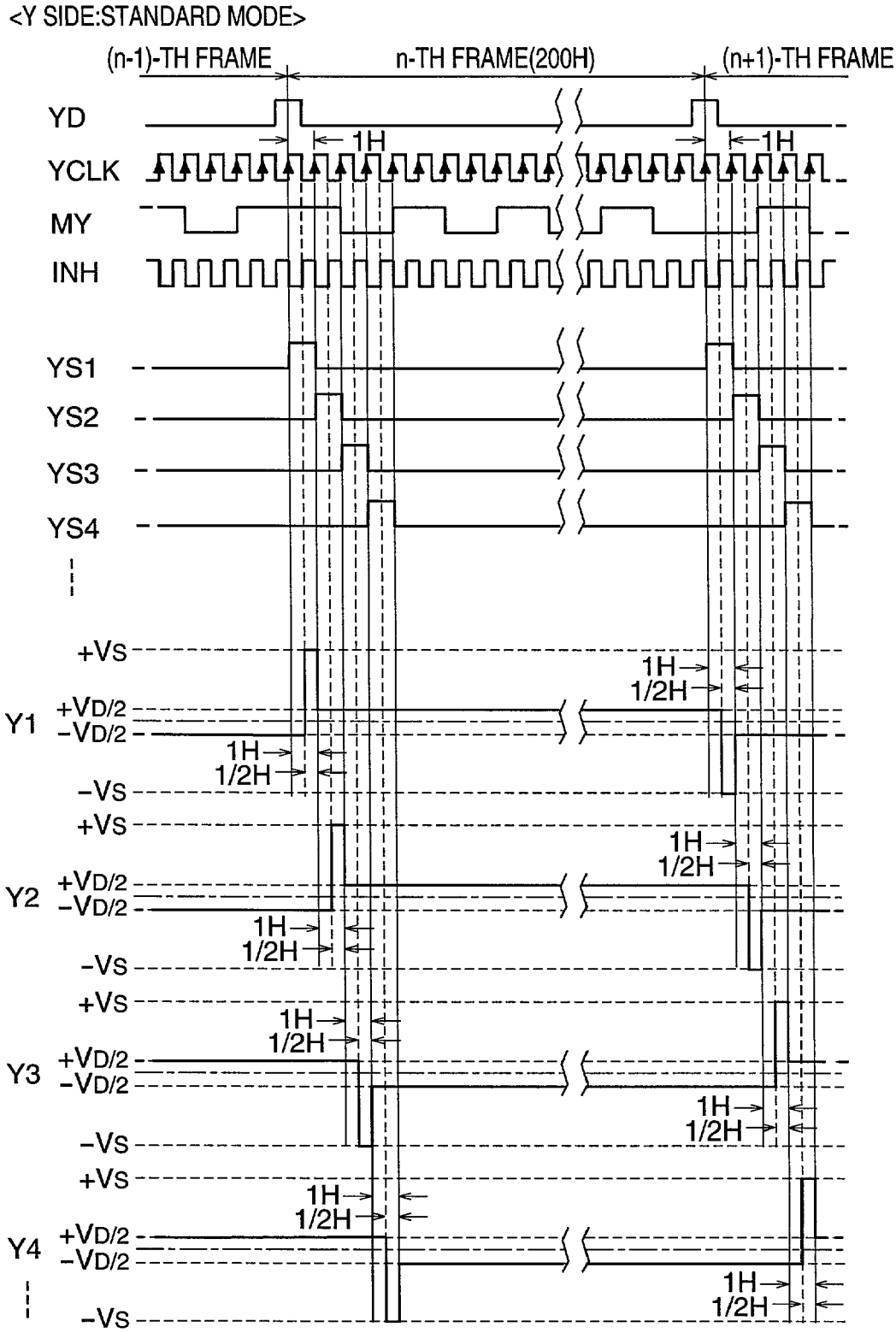
FIG. 7 is a timing chart showing the operation of the Y driver.

The control circuit 400 shown in FIG. 1 generates a variety of control signals including a clock signal, as will be described in greater detail below. A start pulse YD, generated first by the control circuit 400, is output at the beginning of one vertical scanning period (one frame) as shown in FIG. 7. A clock signal YCLK is a reference signal for the scanning lines, and has a period 1H corresponding to one horizontal scanning period as shown in FIG. 7. An alternating driving signal MY dictates the polarity of the selection signal for the scanning signal, and is inverted in signal level every two horizontal scanning periods 2H. Moreover, when the same two scanning lines are selected in a subsequent cycle, the signal level of the alternating driving signal MY is inverted in signal level every vertical scanning period. A control signal INH dictates an application period of the selection voltage within one horizontal scanning period 1H. In this embodiment, as shown in FIG. 7, the control signal INH has the same period as that of the clock signal YCLK, and is driven to an active high level for a second half ½H of each horizontal scanning period 1H.

Figure 8:
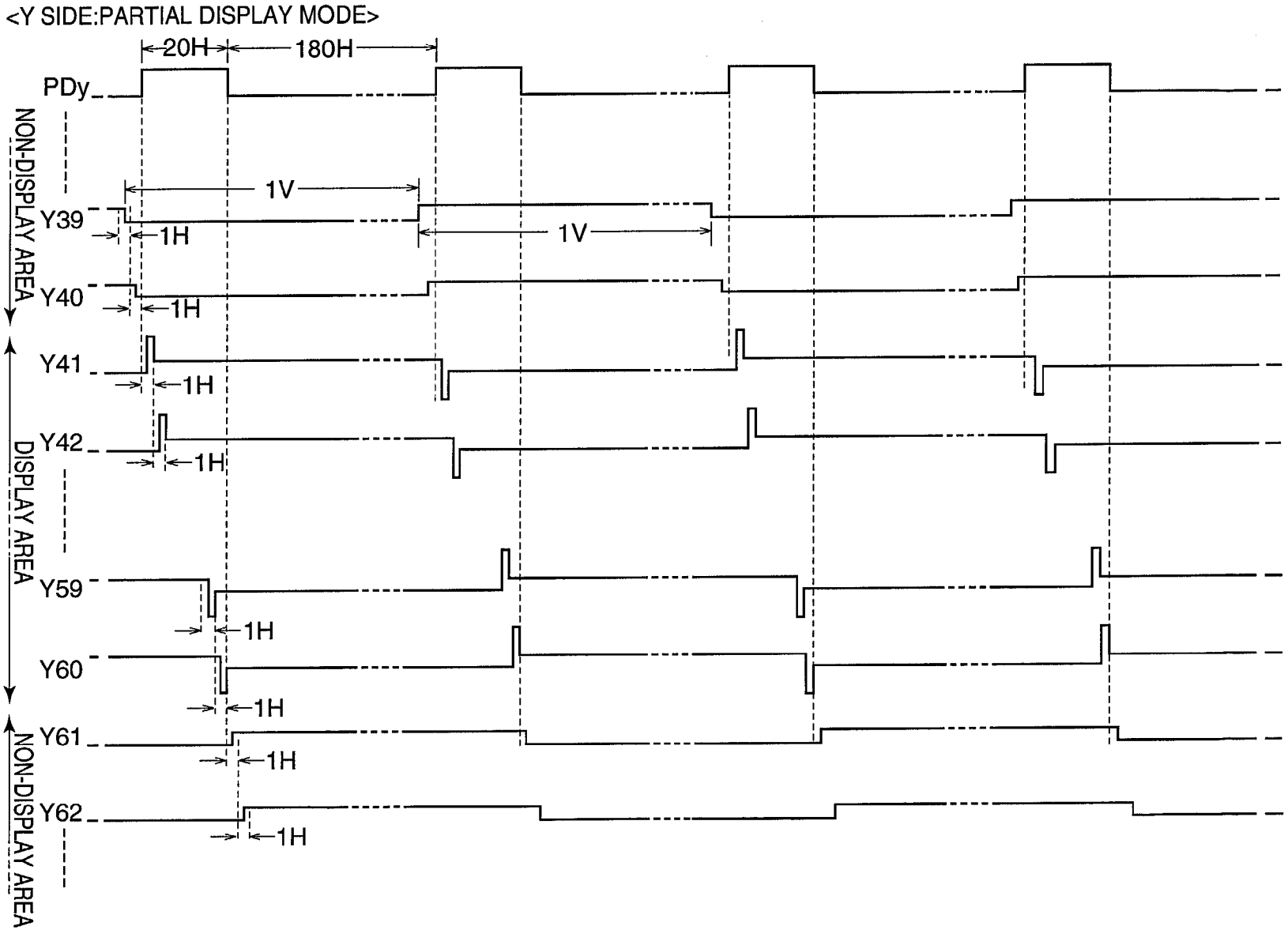
FIG. 8 is a timing chart showing the operation of the Y driver.

A partial display control signal PDy is driven to a high level for a period throughout which the scanning lines 312 contained in the display area are selected to present a display area, and remains at a low level for the rest of time. To present a non-display area as shown in FIG. 5, the partial display control signal PDy remains high in level, as shown in FIG. 8, only while the scanning lines 312 in the 41st row through the 60th row in the display area are selected (for a duration during which the selection voltage is applied as the scanning signals Y41 through Y60). The partial display control signal PDy remains low in level while the scanning lines 312 in the first row through the 40th row and the 61 st row through the 200th row, all of which belong to the non-display area, are selected (for a duration during which the selection voltage is applied as the scanning signals Y1 through Y41 and Y61 through Y200). The partial display control signal PDy remains at a high level when no partial display is presented.

Figure 12:
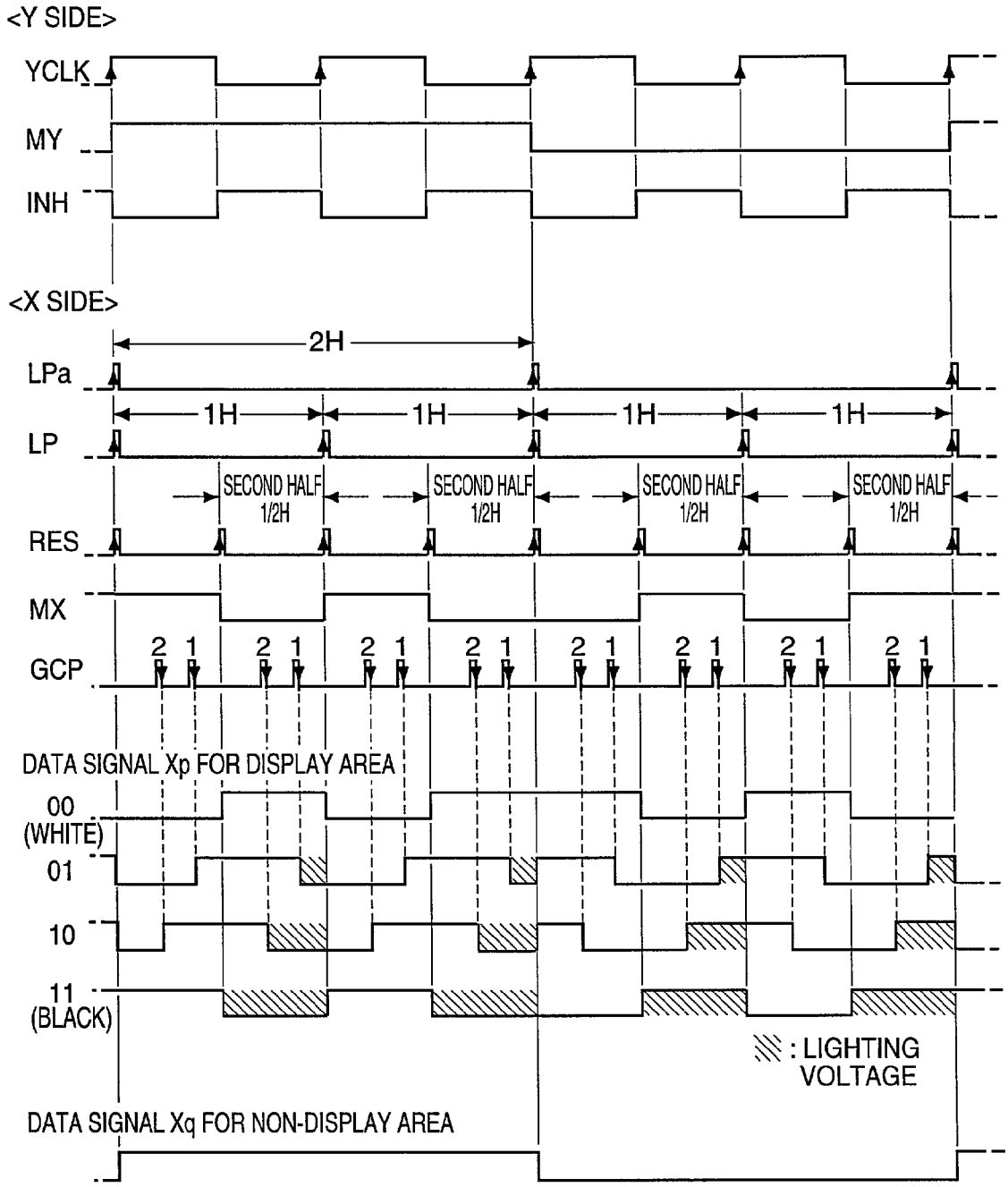
FIG. 12 is a timing chart showing the operation of the X driver.

As shown in FIG. 12, a latch pulse LPa is a pulse which is output at the timing the alternating driving signal MY is transitioned in logical level, namely, is output every two horizontal scanning periods 2H. A latch pulse LP is a reference signal for the data line side, and is output at the start of every horizontal scanning period 1H as shown in FIG. 12. A reset signal RES is output on the data line side at the beginning of a first half and a second half of each horizontal scanning period as shown in FIG. 12.

An alternating driving signal MX dictates the polarity of the data signal for presenting an on display. The alternating driving signal MX is a level inverted version of the alternating driving signal MY when the control signal INH is at a high level (for a duration during which the selection voltage is applied), while being equal to the alternating driving signal MY in level when the control signal INH is at a low level, as shown in FIG. 12.

Referring to FIG. 12, a gradation code pulse GCP is produced at a point, within a duration corresponding to the level of an intermediate gradation level, prior to the end of each of the first half and the second half, into which each horizontal scanning period 1H is divided. In this embodiment, gradation data Dn representing the density of each pixel is expressed by two bits to present a four-gradation display. The gradation data Dn (00) represents an off (white) display, while the gradation data Dn (11) represents an on (black) display. During each of the first half period and the second half period, the gradation code pulse GCP, such as pulses corresponding to gray colors (01) and (10) except white and black, is produced in response to the intermediate gradation level. More specifically, the gradation data (01) and (10) respectively correspond to "1" and "2" of the gradation code pulse GCP as shown in FIG. 12. As shown, the gradation code pulse GCP is set in accordance with the applied voltage—density characteristics (V–I characteristics) of the pixels.

A partial display control data PDx identifies the data line 212 in the non-display area when a partial display is presented. In the partial display shown in FIG. 5, the partial display control data PDx defines the data lines 212 in the first row through the 40th row and the 81 st row through the 160th row.

Figure 6:
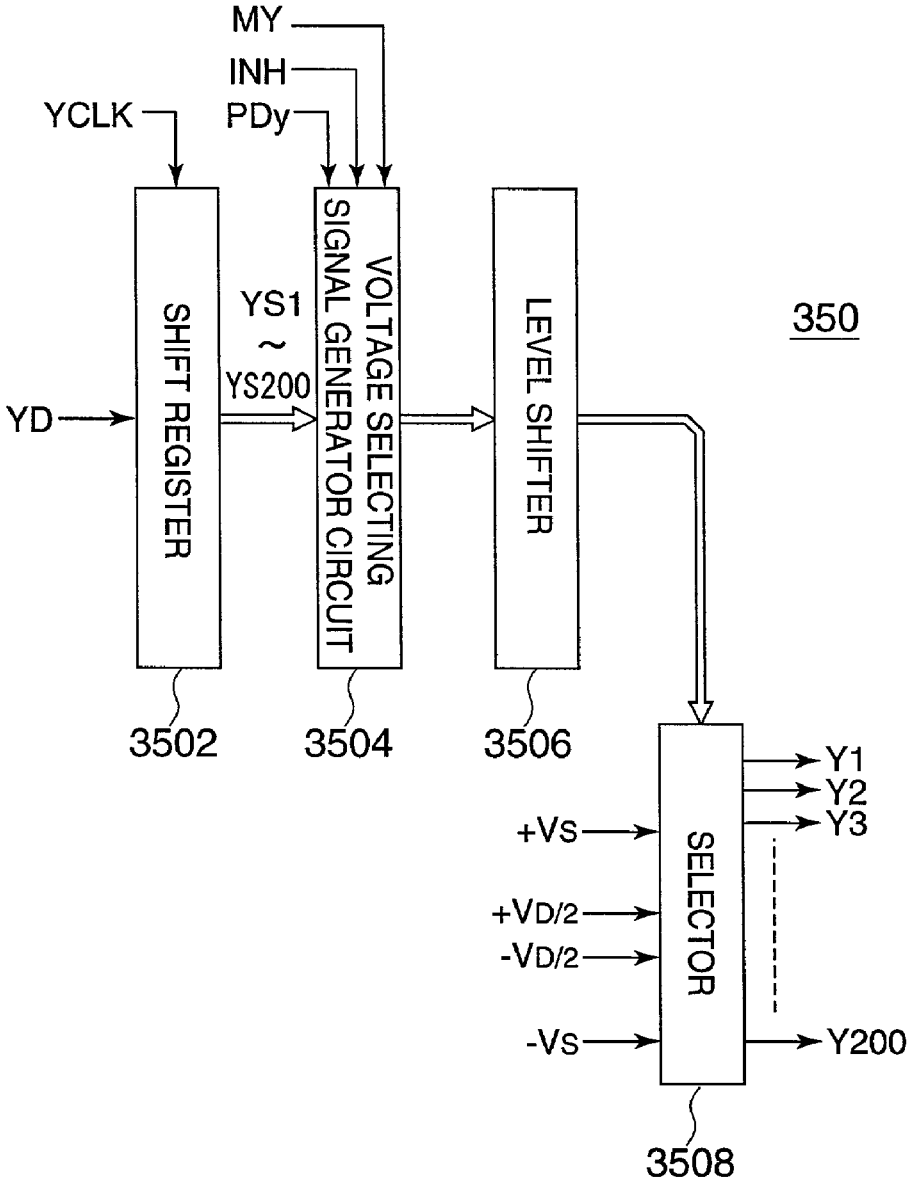
FIG. 6 is an exemplary block diagram showing the construction of a Y driver in the display device.

The Y driver 350 will now be discussed in detail. FIG. 6 is an exemplary block diagram showing the construction of the Y driver 350. As shown, a shift register 3502 is a shift register of 200 bits corresponding to the total number of scanning lines 312. The shift register 3502 shifts the start pulse YD supplied, at the beginning of one vertical scanning period, in response to the clock signal YCLK having the period equal to one horizontal scanning period 1H, thereby successively outputting transfer signals YS1, YS2, . . . , YS200. The transfer signals YS1, YS2, . . . , YS200, respectively, correspond to a first row, a second row, . . . , a 200th row of the scanning lines 312 in a one-to-one correspondence. When the transfer signal is driven to a high level, the corresponding scanning line 312 is selected.

A voltage selecting signal generator circuit 3504 generates a voltage selecting signal, which is supplied to each scanning line 312, in response to the alternating driving signal MY, the control signal INH and the partial display control signal PDy. In this embodiment, as already discussed, the voltages of the scanning signals applied to the scanning lines 312 are four voltages: $+V_S$ (a positive side selection voltage), $+V_D/2$ (a positive side non-selection voltage), $-V_S$ (a negative side non-selection voltage), and $-V_D/2$ (a negative side selection voltage). A period during which the selection voltage $+V_S$ or $-V_S$ is applied is the second half ½H of the one horizontal scanning period. The non-selection voltage is $+V_D/2$ after the selection voltage of +Vs was supplied, and is $-V_D/2$ after the selection voltage of $-V_S$ was supplied. The non-selection voltage is thus dictated by a prior selection voltage.

When the partial display control signal PDy is at a high level, the voltage selecting signal generator circuit 3504 generates the voltage selecting signal so that the scanning signal has the voltage level as described below. When any of the transfer signals YS1, YS2, . . . , YS200 is driven to a high level to select the corresponding scanning line 312, the voltage selecting signal generator circuit 3504 generates the voltage selecting signal so that the voltage level of the scanning signal to the scanning line 312 becomes the selection voltage having the polarity corresponding to the signal level of the alternating driving signal MY when the control signal INH remains at a high level and so that the voltage level of the scanning signal becomes the non-selection voltage corresponding to the selection voltage when the control signal INH is transitioned to a low level. Specifically, the voltage selecting signal generator circuit 3504 outputs the voltage selecting signal for selecting the positive side selection voltage $+V_S$ for a duration during which the control signal INH is at a high level when the alternating driving signal MY is at a high level, and then outputs the voltage selecting signal for selecting the positive side non-selection voltage $+V_D/2$. The voltage selecting signal generator circuit 3504 outputs the voltage selecting signal for selecting the negative side selection voltage $-V_S$ when the alternating driving signal MY is at a low level, and then outputs the voltage selecting signal for selecting the negative side non-selection voltage $-V_D/2$.

In this embodiment, the voltage of the scanning signal supplied to the scanning line 312 in the non-display area takes one of two values of non-selection voltages of $\pm V_D/2$. For this reason, when the partial display control signal PDy is at a low level, the voltage selecting signal generator circuit 3504 generates the voltage selecting signal so that the voltage level of the scanning signal has the following level. Specifically, when the transfer signal corresponding to a certain scanning line is driven to a high level, selecting the scanning line, and when the control signal INH is driven to a high level, selecting the second half of the one horizontal scanning period, the voltage selecting signal generator circuit 3504 generates the voltage selecting signal in order to switch between the positive side non-selection voltage $+V_D/2$ and the negative side non-selection voltage $-V_D/2$ VHN.

In this way, the voltage selecting signal generator circuit 3504 generates the voltage selecting signal for each of the 200 scanning lines 312 in response to the level of the partial display control signal PDy.

A level shifter 3506 enlarges the voltage amplitude of the voltage selecting signal output from the voltage selecting signal generator circuit 3504. A selector 3508 selects a voltage which is indicated by the voltage selecting signal, the amplitude of which is enlarged by the level shifter 3506, and the selector 3508 applies the voltage to the corresponding scanning line 312.

The voltage waveform of the scanning signal supplied from the Y driver 350 thus constructed will now be described in greater detail. For simplicity, a full display screen is in a display area, in other words, the partial display control signal PDy is always a high level. The voltage waveform of the scanning signal is shown in FIG. 7. The start pulse YD is sequentially shifted in response to the clock signal YCLK every horizontal scanning period 1H, and these shifted signals are output as the transfer signals YS1, YS2, . . . , YS200. The control signal INH selects the second half ½H of the one horizontal scanning period 1H. The selection voltage of the scanning signal is determined in response to the level of the alternating driving signal MY for the second half period. As a result, the voltage of the scanning signal supplied to one scanning line becomes the positive side selection voltage $+V_S$ for the second half period ½H of the one horizontal scanning period throughout which the scanning line is selected, when the alternating driving signal MY is at a high level, for example. The scanning signal is then held to the positive side selection voltage $+V_D/2$ corresponding to the selection voltage. After one vertical scanning period (one frame) has elapsed, the alternating driving signal MY is driven to a low level for the second half of one horizontal scanning period, and the voltage of the scanning signal supplied to the scanning line becomes the negative side selection voltage $-V_S$, and is then held to the negative side non-selection voltage $-V_D/2$ corresponding to the selection voltage.

For example, the voltage of the scanning signal Y1 to the first scanning line 312 in an n-th frame takes the positive side selection voltage $+V_S$ for the second half of the horizontal scanning period, and is then held to the positive side non-selection voltage $+V_D/2$ as shown in FIG. 7. For the second half of the next horizontal scanning period, the alternating driving signal MY is driven to a low level, inverted from the previously selected level, and the voltage of the scanning signal Y1 to the scanning line takes the negative side selection voltage $-V_S$, and is then held to the negative side non-selection voltage $-V_D/2$. The above steps are cycled through.

Since the alternating driving signal MY is inverted in signal level every two horizontal scanning periods 2H, the voltage of the scanning signal supplied to the scanning line 312 is inverted every two horizontal scanning periods, namely, every two scanning lines. In an n-th frame as shown in FIG. 7, both the selection voltage of the scanning signal Y1 in the first row and the selection voltage of the scanning signal Y2 in the second row become the positive side selection voltage $+V_S$. Further, both the selection voltage of the scanning signal Y3 in the third row and the selection voltage of the scanning signal Y4 in the fourth row become the negative side selection voltage $-V_S$.

The scanning signal for the partial display will now be described in greater detail. The partial display shown in FIG. 5 is discussed by way of example. The partial display remains unchanged from the full display mode in that the start pulse YD is successively shifted every horizontal scanning period 1H in response to the clock signal YCLK, becoming the transfer signals YS1, YS2, . . . , YS200. However, the partial display control signal PDy remains at a low level for a period during which the scanning lines in the first row through the 40th row and the 61st row through the 200th row are selected out of one vertical scanning period (1V). Referring to FIG. 8, the partial display control signal PDy continuously remains low for a total of 180 horizontal scanning periods from the $61^{st}$ horizontal scanning period in a given one frame to the 40th horizontal scanning period in a next frame. For this reason, during the 180 horizontal scanning periods, the transfer signals YS1 through YS40 and YS61 through YS200 corresponding to these scanning lines are transitioned to a high level, and the control signal INH is driven to a high level. The voltage of the scanning signal supplied to each of the scanning lines in the first row through the 40th row and the 61st row through the 200th row is switched from the non-selection voltage $+V_D/2$ to the non-selection voltage $-V_D/2$ or from the non-selection voltage $-V_D/2$ to the non-selection voltage $+V_D/2$.

The partial display control signal PDy is driven to a high level for 20 horizontal scanning periods of the one vertical scanning period, during which the scanning lines in the 41 st row through the 60th row are selected. During these 20 horizontal scanning periods, the partial display mode remains unchanged from the full display mode in terms of the scanning signals Y41 through Y60 respectively supplied to the scanning lines in the 41 st row through the 60th row.

The scanning signal to present the partial display shown in FIG. 5, particularly, the scanning signal supplied to the scanning line on the border between the non-display area and the display area is shown in FIG. 7. Specifically, each of the scanning signals Y1 through Y40 and Y61 through Y200 for the scanning lines in the first row through the 40th row and the 61 st row through 200th row in the non-display areas is switched between the non-selection voltage $+V_D/2$ and the non-selection voltage $-V_D/2$ at the intermediate point of the one horizontal scanning period throughout which the corresponding scanning line is selected. For this reason, in the present embodiment the scanning signal for the non-display areas takes the non- selection voltage with the polarity thereof switched every vertical scanning period (one frame).

From the standpoint of power saving, a scanning signal to a non- displayed area is preferably the intermediate voltage between the voltages, $+V_D/2$ and $-V_D/2$ that is applied to the data signal, namely zero volts. In this arrangement, the driving voltage generator circuit 500 (see FIG. 1) needs to generate an intermediate voltage, and the number of bits for the voltage selecting signal is additionally required in the voltage selecting signal generator circuit 3504 (see FIG. 4). The selection range in the selector 3508 is expanded. The complexity of the circuitry is thus increased.

In contrast, the arrangement of this embodiment is not so much different from the conventional art that performs the full display mode only, and is thus free from an increase in complexity. The application of the scanning signal to the non-display area is performed by simply switching a low non-selection voltage every vertical scanning period 1V, which is substantially long. Power consumed by the Y driver 350 to present a partial display is kept to be as low as that consumed by the arrangement in which the intermediate voltage of the data signal is supplied.

Figure 9:
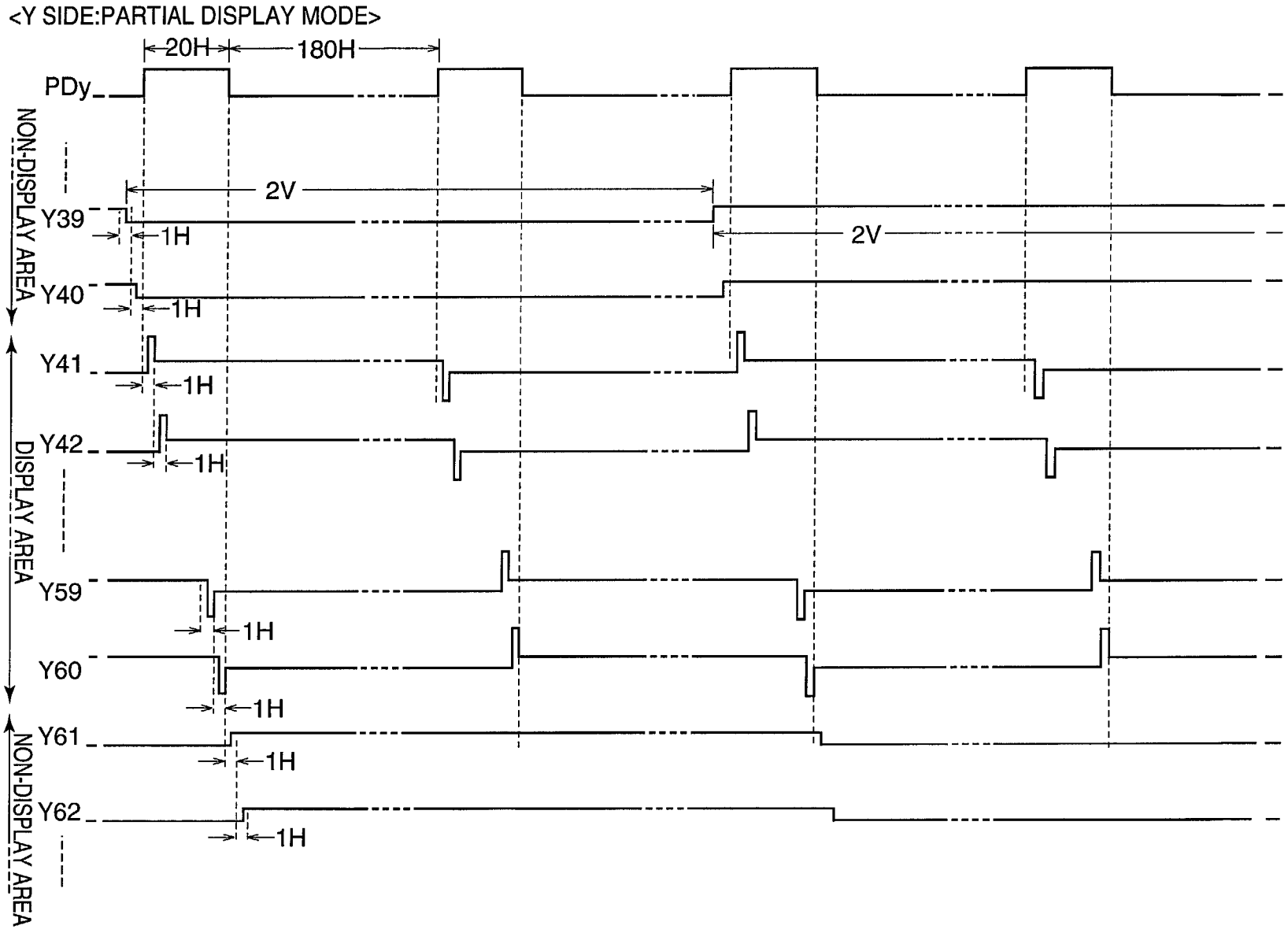
FIG. 9 is a timing chart showing the operation of the Y driver.

The switching period of the non-selection voltage is 1V corresponding to the one vertical scanning period in this embodiment. Power consumption involved in voltage switching is even more reduced if the switching Fu period is further prolonged. Referring to FIG. 9, the switching period of the non- selection voltage may be 2V corresponding to two vertical scanning periods, or may be longer than 2V. Fixing the scanning signal for the non-display area to one of the non-selection voltages $+V_D/2$ and $-V_D/2$ is not preferable in the display device which works on the alternating driving method.

Figure 10:
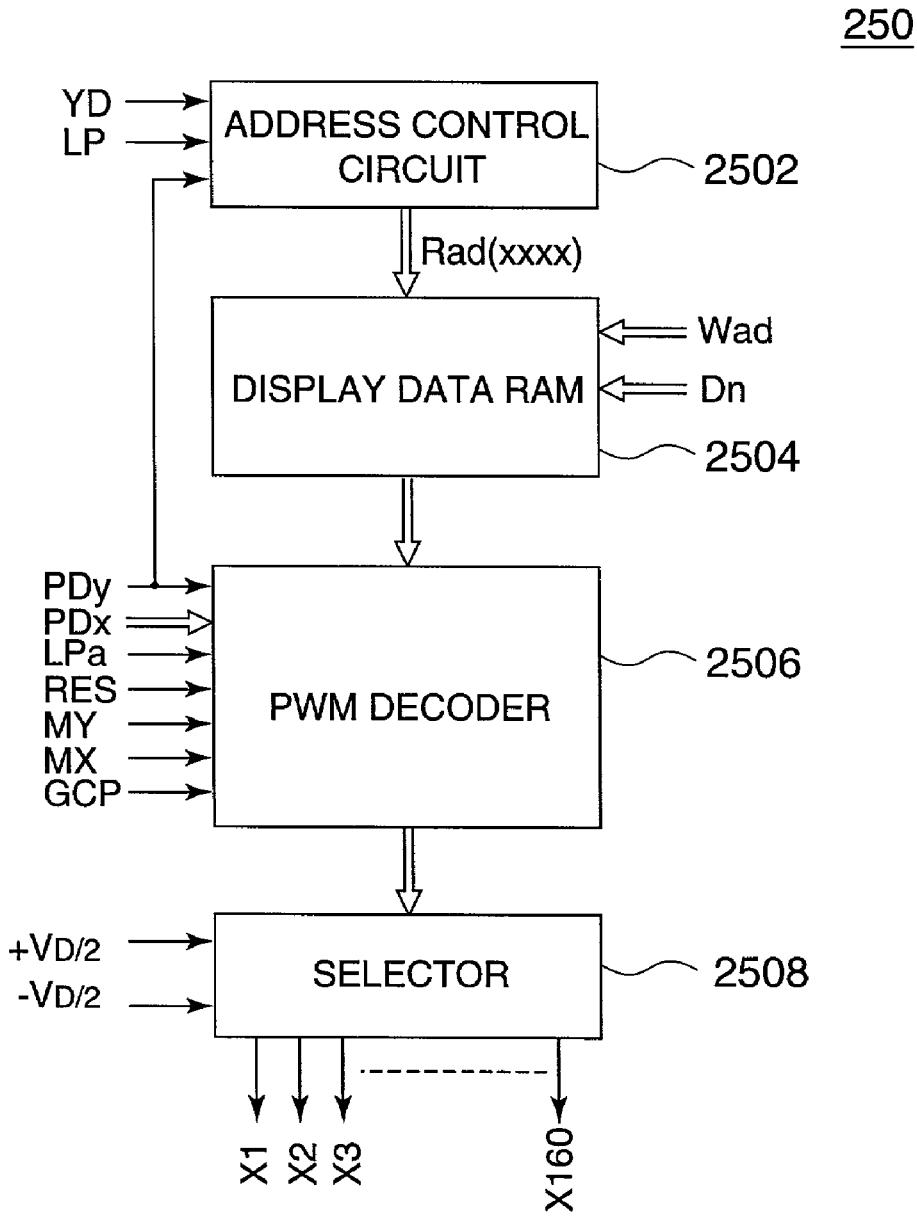
FIG. 10 is an exemplary block diagram showing the construction of an X driver in the display device.

The construction of the X driver 250 will now be described in greater detail. FIG. 10 shows an exemplary block diagram showing the construction of the X driver 250. As shown, an address control circuit 2502 generates an address Rad of one row to be used to read the gradation data. The address control circuit 2502 resets the address Rad in response to the start pulse YD supplied at the beginning of one vertical scanning period while successively shifting the address in response to the latch pulse LP supplied every horizontal scanning period. When the partial display control signal PDy is driven to a low level, the address control circuit 2502 inhibits the outputting of the row address Rad.

A display data RAM 2504 is a dual-port RAM having an area corresponding to a matrix of 200 rows by 160 columns of pixels, and writes the gradation data Dn supplied from an unshown processing circuit on a write side in an address specified by a write address Wad, and reads, in dump, one row (160 pieces) of gradation data Dn at the address specified by the address Rad on a read side. When the partial display control signal PDy is at a low level, the outputting of the row address Rad is inhibited, and no gradation data Dn is read from the display data RAM 2504.

A PWM decoder 2506 generates the voltage selecting signal for selecting the voltage of each of the data signals X1, X2, . . . , X160 from the reset signal RES, the alternating driving signals MX and MY, and the gradation code pulse GCP, etc in response to one row of gradation data Dn read.

In this embodiment, the voltage of a data signal applied to the data line 212 is either $+V_D/2$ or $-V_D/2$, and the gradation data Dn has two bits (namely, four gradation levels) as already discussed. When the partial display control signal PDy is at a high level, the PWM decoder 2506 generates the voltage selecting signal so that the voltage level of the data signal is related to each piece of gradation data Dn for the one row that is read.

Specifically, when a single piece of the gradation data Dn represents an intermediate gradation (gray) level display other than the on display and the off display, the PWM decoder 2506 resets the voltage selecting signal to have a polarity opposite to an immediately prior polarity specified by the logical level of the alternating driving signal MX, at the rising edge of the latch pulse LPa, and then sets the voltage selecting signal to have the same polarity as that of the logical level of the alternating driving signal MX at the falling edge corresponding to the gradation data Dn out of the gradation code pulse GCP. The PWM decoder 2506 generates the voltage selecting signal by repeating these steps until the next latch pulse LPa is supplied.

When the gradation data Dn is (00) for the off (white) display, the PWM decoder 2506 generates the voltage selecting signal to have a polarity opposite to the polarity represented by the logical level of the alternating driving signal MX, using the reset signal RES. When the gradation data Dn is (11) for the on (black) display, the PWM decoder 2506 generates the voltage selecting signal to have the same polarity as that represented by the logical level of the alternating driving signal MX, using the reset signal RES. The PWM decoder 2506 generates the voltage selecting signal of the data line 212 identified by the partial display control data PDx to have the same polarity as that represented by the logical level of the alternating driving signal MY, regardless of the corresponding gradation data Dn.

On the other hand, when the partial display control signal PDy is at a low level, the PWM decoder 2506 generates the voltage selecting signal so that the voltage of the data signal is switched between the positive side voltage $+V_D/2$ and the negative side voltage $-V_D/2$ with a period that is determined by dividing the low level period by an even number. In this embodiment, the even number is "6."

The PWM decoder 2506 generates the voltage selecting signal in response to each of the read 160 pieces of gradation data Dn. The selector 2508 selects the voltage designated by the voltage selecting signal provided by the PWM decoder 2506, and supplies the corresponding data line 212 with the selected voltage. Furthermore, the selector 2508 selects the voltage designated by the voltage selecting signal provided by the PWM decoder 2506, and applies the corresponding data line 212 with the selected voltage.

Figure 11:
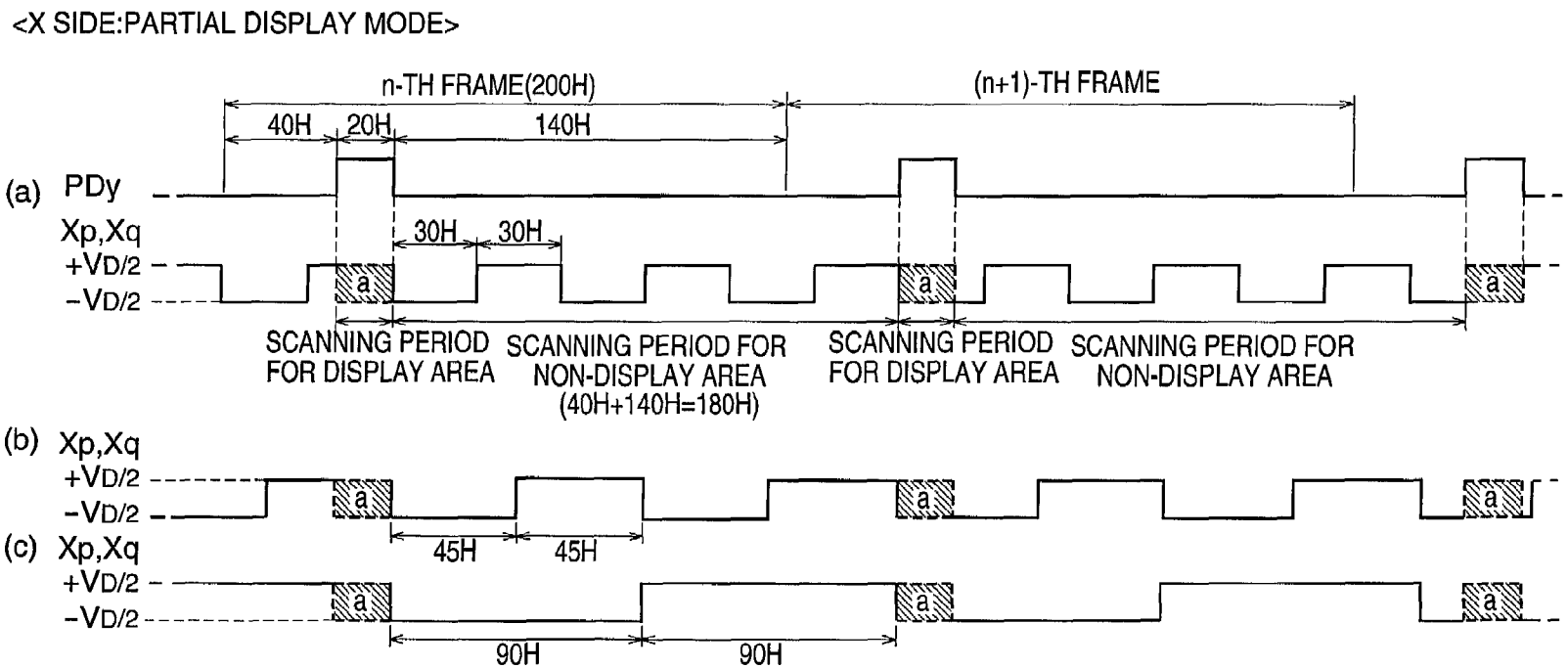
FIG. 11 is a timing chart showing the operation of the X driver.

The voltage waveforms of the data signal supplied by the above- referenced X driver 250 will now be described in greater detail. To present the partial display shown in FIG. 5, the partial display control signal PDy remains at a high level for 20 horizontal scanning periods out of one frame, during which the 21 st through the 40th scanning lines are selected, while being at a low level for 180 horizontal scanning periods, during which the first through the 40th and the 61st through the 200th scanning lines are selected, as shown in FIG. 11.

For simplicity, the duration during which the partial display control signal PDy (namely, the duration during the scanning signals within the display area are selected) will now be described in greater detail. The data signal supplied from the X driver 250 becomes different depending on whether the data signal is for the display area or for the non-display area. Areas (a) in FIG. 11(*a*) indicate such a difference.

A data signal Xp supplied to the data line 212 in the display area (Xp refers to X41 through X80 in the display example shown in FIG. 5) corresponds to the gradation data Dn of the pixels 116 at the intersections of the selected scanning lines 312 and the data line 212 in the p-th column. When the gradation data Dn is other than (00) or (11) as shown in FIG. 12, the voltage selecting signal from the PWM decoder 2506 resets the voltage of the data signal Xi to have a polarity opposite to the polarity specified by the logical level of the alternating driving signal MX, at the rising edge of the latch pulse LPa, and sets the voltage of the data signal Xi to have the same polarity as that of the logical level of the alternating driving signal MX at the falling edge corresponding to the gradation data Dn out of the gradation code pulse GCP. The voltage level of the data signal Xi is set to have a polarity opposite to the polarity represented by the logical level of the alternating driving signal MX when the gradation data Dn is (00) for the off (white) display, and is set to have the same polarity as that represented by the logical level of the alternating driving signal MX when the gradation data Dn is (11) for the on (black) display. Regardless of the gradation data, the duration for the positive side voltage $+V_D/2$ equals the duration for the negative side voltage $-V_D/2$ in the data signal Xp for each horizontal scanning period 1H.

When the partial display control signal PDy is at a high level, the data signal Xq supplied to the data line 212 in the non-display area (the data signal Xq refers to X1 through X40 and X81 through X160 in the display example shown in FIG. 5) is set to be the same polarity as that represented by the logical level of the alternating driving signal MY, namely, as that of the selection voltage, as shown in FIG. 12. The data signal Xq is either the positive side voltage $+V_D/2$ or the negative side voltage $-V_D/2$ in a given horizontal scanning period 1H. If a relatively long period of time, such as one vertical scanning period, is considered, the duration for the positive side voltage $+V_D/2$ equals the duration for the negative side voltage $-V_D/2$. Referring to FIG. 12, data signals Xp and Xq show that four pieces of gradation data Dn of four pixels adjacent in the Y direction are equal to each other.

Discussed next is the duration, during which the partial display control signal PDy is now at a low level (the scanning line in the non-display area is selected). The voltage of the data signal supplied from the X driver 250 is switched between the positive side voltage $+V_D/2$ and the negative side voltage $-V_D/2$ every 30 horizontal scanning periods 30H as shown in FIG. 11(*a*). Here, the 30 horizontal scanning periods 30H are determined by dividing a total of 180 horizontal scanning periods, during which the partial display control signal PDy remains at a low level, by "6."

For the duration during which the partial display control signal PDy remains low, the duration for the positive side voltage $+V_D/2$ equals the duration for the negative side voltage $-V_D/2$. Therefore, for the duration during which the scanning lines within the non-display area are selected, the root-mean-square value of the data signal becomes substantially zero.

From the standpoint of power saving, the voltage of the data signal, for a duration during which the scanning lines falling within the non-display area are consecutively selected, is preferably the intermediate voltage between the voltages $+V_D/2$ and $-V_D/2$, namely, zero volt. In this arrangement, the driving voltage generator circuit 500 (see FIG. 1) needs to separately generate an intermediate voltage, and the number of bits for the voltage selecting signal is additionally required in the PWM decoder 2506 (see FIG. 10). Furthermore, the selection range in the selector 2508 is expanded. The complexity of the circuitry is thus increased. In contrast, the arrangement of this embodiment is slightly different in this respect from the conventional art that performs the full display mode only, and is thus free from an increase in complexity. The voltage of the data signal, for a duration during which the scanning lines falling within the non-display area are consecutively selected, is switched between the positive side voltage $+V_D/2$ and the negative side voltage $-V_D/2$ every 30 horizontal scanning periods, which are substantially longer than one horizontal scanning period, during which the scanning line in the display area is selected. Power consumed by the X driver 250 to present a partial display is kept to be as low as that consumed by the arrangement in which the intermediate voltage of the data signal is supplied.

When the partial display control signal PDy is at a low level, the outputting of the row address Rad by the address control circuit 2502 is inhibited in this embodiment as already discussed. While the partial display control signal PDy remains at a low level, no display is presented, and the gradation data Dn is not needed. An arrangement is acceptable in which the PWM decoder 2506 simply disregards the display data read from the display data RAM for the duration during which the partial display control signal PDy is at a low level. However, if the supplying of the row address is positively inhibited as in this embodiment, power that might be required to read the display data is saved.

For the duration during which the partial display control signal PDy is at a low level, no display is presented and the gradation code pulse GCP is not required. If the control circuit 400 positively inhibits the generation of the gradation code pulse GCP with the partial display control signal PDy at a low level, power that might be involved in the capacitance of wirings and power that might be consumed in the operation responsive to the gradation code pulse GCP are saved.

In this embodiment, the inversion period of the data signal is set to be the period that is determined by dividing the low level period, throughout which the partial display control signal PDy remains low, by "6." An even number, which may be larger than or smaller than 6, is employed.

Figure 14:
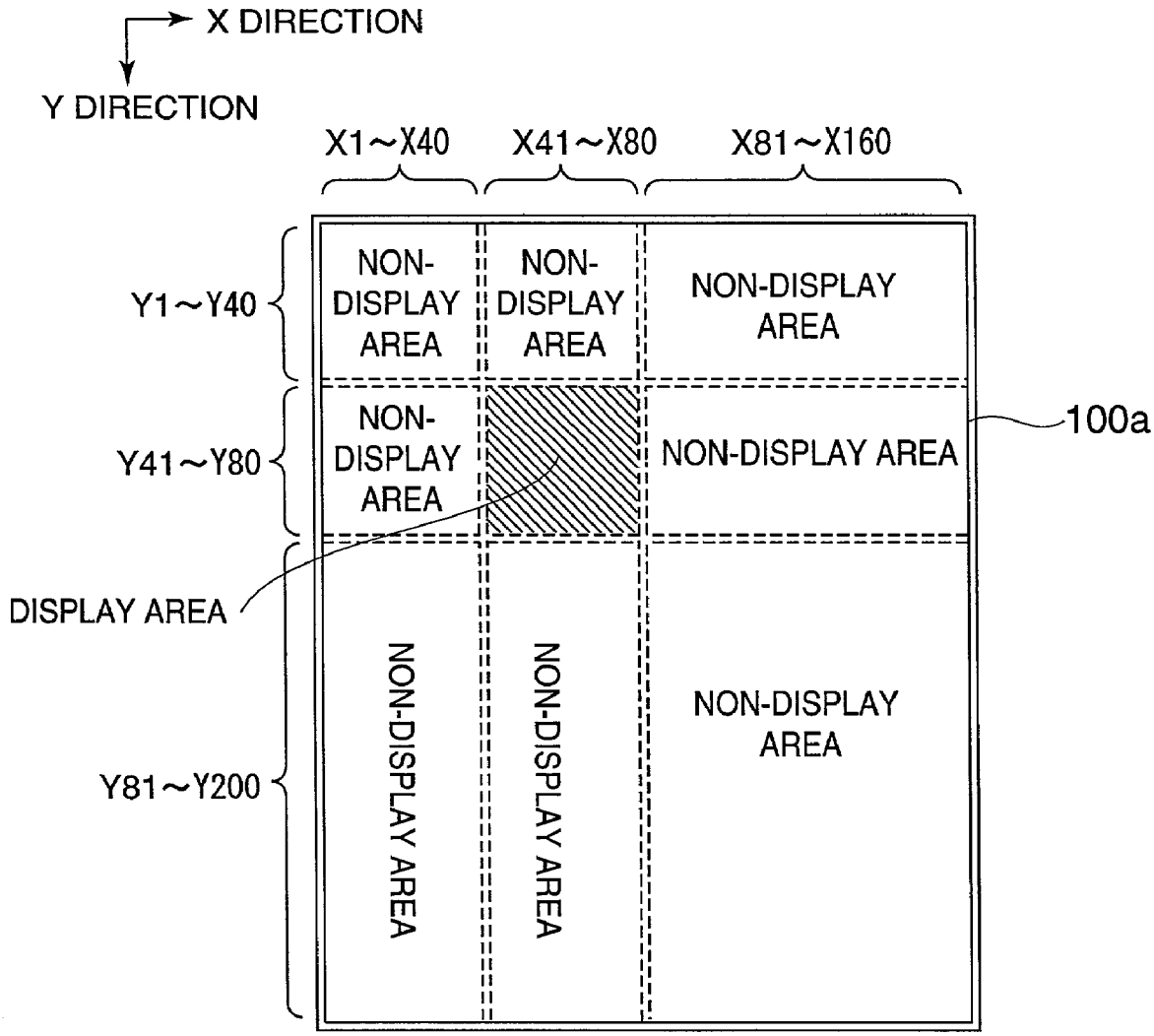
FIG. 14 shows another embodiment of the partial display.
Figure 15:
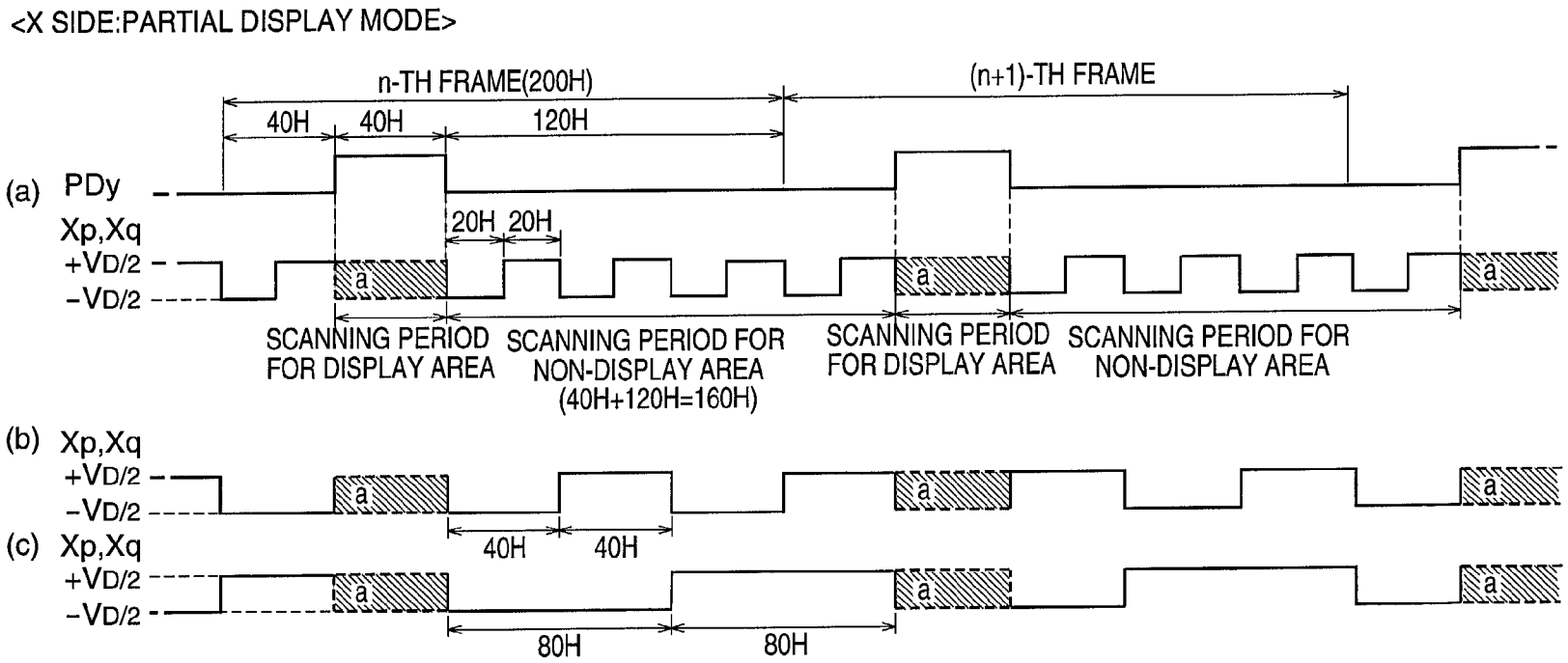
FIG. 15 is a timing chart showing the operation of the X driver.

For example, when the partial display is presented as shown in FIG. 14, the partial display control signal PDy within one frame is at a low level for a total of 160 horizontal scanning periods, with the scanning lines in the first row through the 40th row and the 81 st row through the 200th row selected, as shown in FIG. 15. Referring to FIG. 15(*a*), the data signal is switched between the positive side voltage $+V_D/2$ and the negative side voltage $-V_D/2$ every 20 horizontal scanning periods 20H that are determined by dividing the 160 horizontal scanning periods by "8."

The data signal may be switched every duration of time that is determined by dividing the low level period "4" as shown in FIG. 11(*b*) or FIG. 15(*b*). Alternatively, the data signal may be switched every duration of time that is determined by dividing the low level period by "2" as shown in FIG. 11(*c*) or FIG. 15(*c*). The divisor of "2" can be the most preferable from the standpoint of equalizing the duration for the positive side voltage $+V_D/2$ with the duration for the negative side voltage $-V_D/2$ and of reducing the switching frequency to a minimum.

Even when the duration during which the partial display control signal PDy remains low is not divisible by an even number, it can be preferable that both periods be as close to one another as possible. For example, if the partial display control signal PDy remains low for 179 horizontal scanning periods, 90 horizontal scanning periods are set for the positive side voltage $+V_D/2$ and 89 horizontal scanning periods are set for the negative side voltage $-V_D/2$. Furthermore, the duration for the positive side voltage $+V_D/2$ is 90 horizontal scanning periods and the duration for the negative side voltage $-V_D/2$ is 89 horizontal scanning periods, and then, this setting is reversed with the duration for the positive side voltage $+V_D/2$ set for 89 horizontal scanning periods and the duration for the negative side voltage $-V_D/2$ set for 90 horizontal scanning periods.

Figure 13:
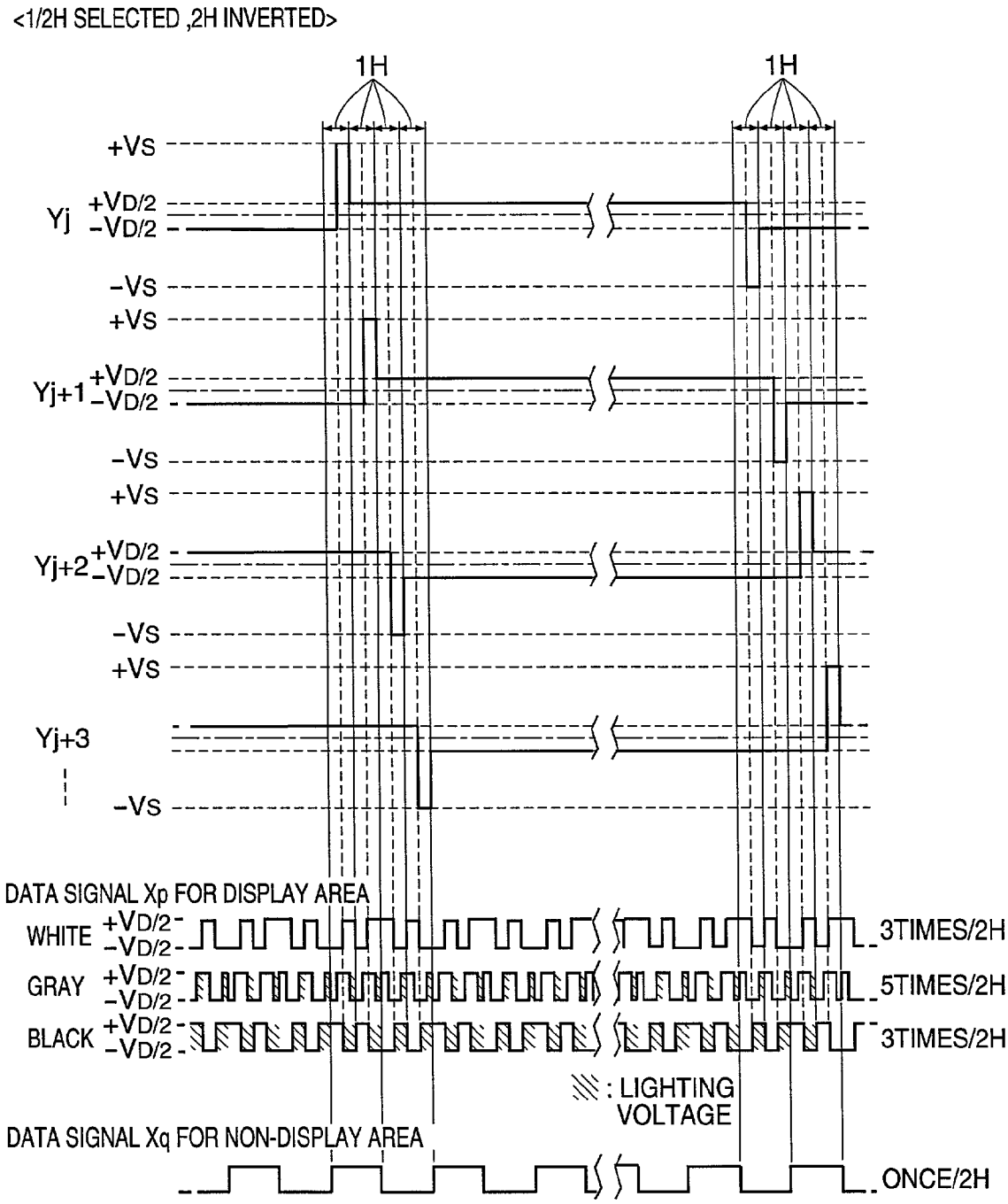
FIG. 13 is a timing chart showing the relationship between waveforms and the gradation of pixels with a partial display control signal PDy at a high level.

The frequency of voltage switching of the data signals Xp and Xq with the partial display control signal PDy at a high level will now be described in greater detail with respect to FIG. 13. In this embodiment, the frequency of voltage switching of the data signal Xp to the data line 212 in the display area is three times per two horizontal scanning periods 2H throughout which the scanning lines having the same polarity of selection voltage are selected, when pixels in the off (white) display or the on (black) display appear contiguously in the direction of columns, and the frequency of voltage switching is five times per two horizontal scanning periods 2H when pixels in the gray display are contiguously appear in the direction of columns.

If simply compared with the conventional four-value driving method (½ selected and 1H inverted) shown in FIG. 26, the frequency of voltage switching of the data signal for the display area is high. The frequency of voltage switching of the data signal Xq to the data line 212 in the non-display area is once per two horizontal scanning periods 2H, and is thus half the frequency of voltage switching when the signal for the off (white) display is supplied.

The partial display is now presented on the display device of this embodiment, as shown in FIG. 5. If, for the duration during which the scanning lines within the display area are consecutively selected, a decrease in power consumption as a result of a drop in the frequency of voltage switching of the data signal Xq for the non-display area becomes greater than an increase in power consumption as a result of an increase in the frequency of voltage switching of the data signal Xp in the display area, power saving is performed. Since the partial display shown in FIG. 5, different from a standard use mode such as a standby mode, typically presents a minimum amount of information, and a small number of data lines 212 in the display area is sufficient. For this reason, an increase in power consumption as a result of an increase in the frequency of voltage switching of the data signal Xp in the display area can be neglected in practice. A decrease in power consumption as a result of a drop in the frequency of voltage switching of the data signal Xq for the non-display area is thus considered significant.

Figure 16:
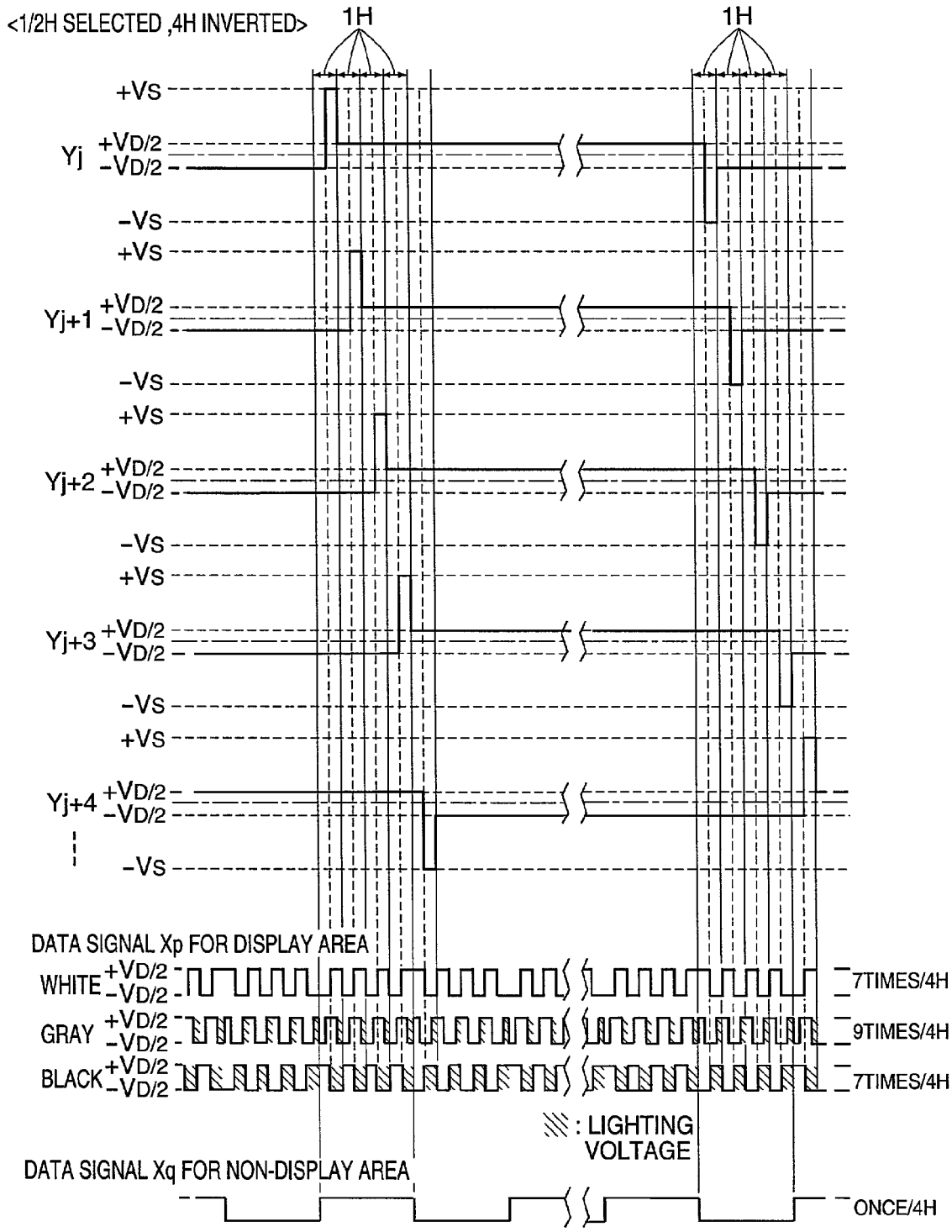
FIG. 16 is a timing chart showing the relationship between waveforms and the gradation of pixels with a partial display control signal PDy at a high level in a modification of the embodiment.

In the first embodiment, the selection voltage is inverted in polarity every two horizontal scanning periods. However, it is to be understood that the present invention is not limited to this arrangement. The selection voltage may be inverted in polarity every three horizontal scanning periods. As shown in FIG. 16, for example, the selection voltage may be inverted in polarity every four horizontal scanning periods 4H.

The selection voltage is now inverted in polarity every four horizontal scanning periods 4H. In this arrangement, in a period in which scanning lines belonging to the display area are consecutively selected, the frequency of voltage switching of the data signal Xp to the data line 212 in the display area is seven times per four horizontal scanning periods 4H throughout which the scanning lines having the same polarity of selection voltage are selected, when pixels in the off (white) display or the on (black) display appear contiguously in the direction of columns, and the frequency of voltage switching is nine times per four horizontal scanning periods 4H when pixels in the gray display are contiguous in the direction of columns. The frequency of voltage switching of the data signal for the display area is not much different from that in the conventional four-value driving method (½ selected and 1H inverted) shown in FIG. 26. The frequency of voltage switching of the data signal Xq to the data line 212 in the non-display area is once per four horizontal scanning periods 4H, and is substantially reduced.

Generally in this embodiment, the polarity inversion period of the selection voltage is set to be m horizontal scanning periods. In this arrangement, in a period in which scanning lines belonging to the display area are consecutively selected, the frequency of voltage switching of the data signal Xp to the data line 212 in the display area is (2 m−1) times per m horizontal scanning periods mH, when pixels in the off (white) display or the on (black) display appear contiguously in the direction of columns, and the frequency of voltage switching is (2 m+1) times per m horizontal scanning periods mH when pixels in the gray display are contiguously appear in the direction of columns. Furthermore, the frequency of voltage switching of the data signal Xq to the data line 212 in the non-display area is once per m horizontal scanning periods mH.

As the polarity inversion period of the selection voltage is prolonged, the frequency of voltage switching of the data signal Xp for the display area becomes close to once per one horizontal scanning period, and the frequency of voltage switching of the data signal Xq for the non-display area is reduced. Power consumption is thus reduced.

As described above, the polarity inversion period of the selection voltage coincides with the inversion period of the logical level of the alternating driving signal MY. For this reason, controlling the inversion period of the logical level of the alternating driving signal MY also sets the polarity inversion period of the selection voltage to a desired period.

In the above discussion, the voltage switching timing of the data signal Xq to the non-display area is set to be at the beginning of one horizontal scanning period for selecting a single scanning line 312. Since the selection voltage is applied within the second half period, the voltage switching timing of the data signal Xq may be set to be at the beginning of the second half period. Specifically, the data signal Xq to the non-display area may be delayed by half the one horizontal scanning period, ½H, from that shown in FIG. 12, FIG. 13, and FIG. 16. The duration during which the selection voltage is applied is set to be within the second half of the one horizontal scanning period 1H. Alternatively, the selection voltage may be applied within the first half of the one horizontal scanning period 1H.

In the above-referenced first embodiment, for the duration during which the scanning lines within the display area are consecutively selected, the frequency of voltage switching of the data signal Xq to the non-display area is reduced while the frequency of voltage switching of the data signal Xp for the display area tends to increase. A second embodiment intended to limit the frequency of voltage switching of the data signal Xp for the display area will now be described. The display device of the second embodiment is identical to the first embodiment in mechanical and electrical construction, however, it is different from the first embodiment in the control signals. The difference of the second embodiment from the first embodiment will be mainly described.

In the second embodiment, the polarity inversion period of the selection voltage is four horizontal scanning periods 4H. Therefore, the logical level of the alternating driving signal MY is also inverted every four horizontal scanning periods. In more detail, the logical level of the alternating driving signal MY is inverted every four horizontal scanning periods 4H in which four scanning lines 312 are selected, for example, of the first through fourth rows, the fifth through eighth rows, the ninth through twelfth rows, . . . , the 197th through 200th rows.

Figure 17:
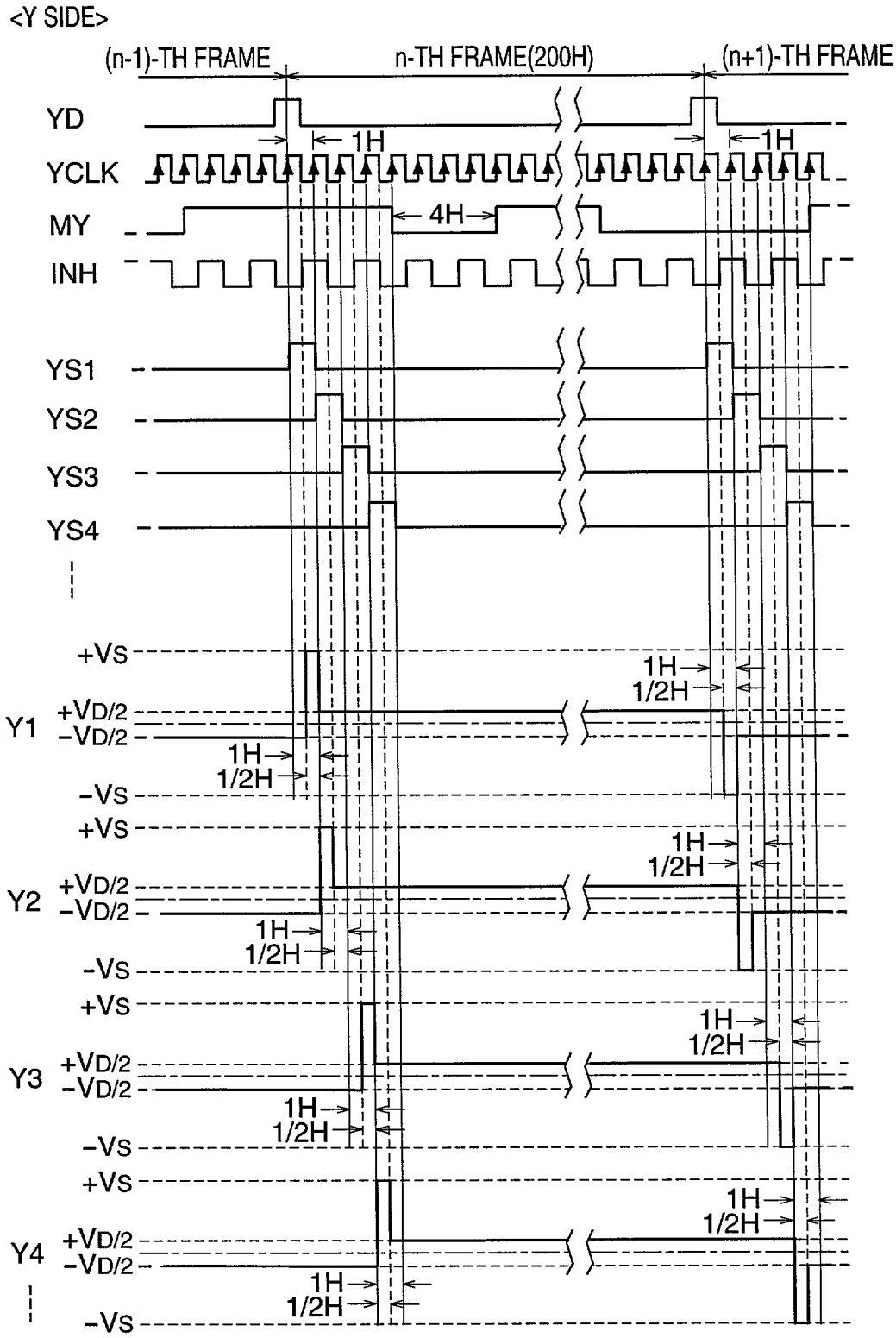
FIG. 17 is a timing chart showing the operation of the Y driver in a display device of a second embodiment of the present invention.

In this embodiment, the control signal INH dictating the application period of the selection voltage in one horizontal scanning period 1H has twice the period of the clock signal YCLK as shown in FIG. 17, and remains high throughout the second half of one horizontal scanning period for selecting an odd row scanning line 312 and the first half of one horizontal scanning period for selecting a next even row scanning line 312. For this reason, the selection voltage of the scanning signal is applied for the second half of the one horizontal scanning period 1H during which the odd row scanning line 312 is selected, and for the subsequent even row scanning line 312, the selection voltage is applied for the first half of the one horizontal scanning period, during which the scanning line is selected.

On the X side, the alternating driving signal MX becomes different because the alternating driving signal MY and the control signal INH are modified. Specifically, the logical level of the alternating driving signal MX is an inverted version of the logical level of the alternating driving signal MY when the control signal INH is at a high level. The logical level of the alternating driving signal MX remains the same as that of the alternating driving signal MY when the control signal INH is at a low level. In that sense, the second embodiment is identical to the first embodiment. Since the alternating driving signal MY and the control signal INH are modified as described above, the alternating driving signal MX is modified accordingly.

Figure 18:
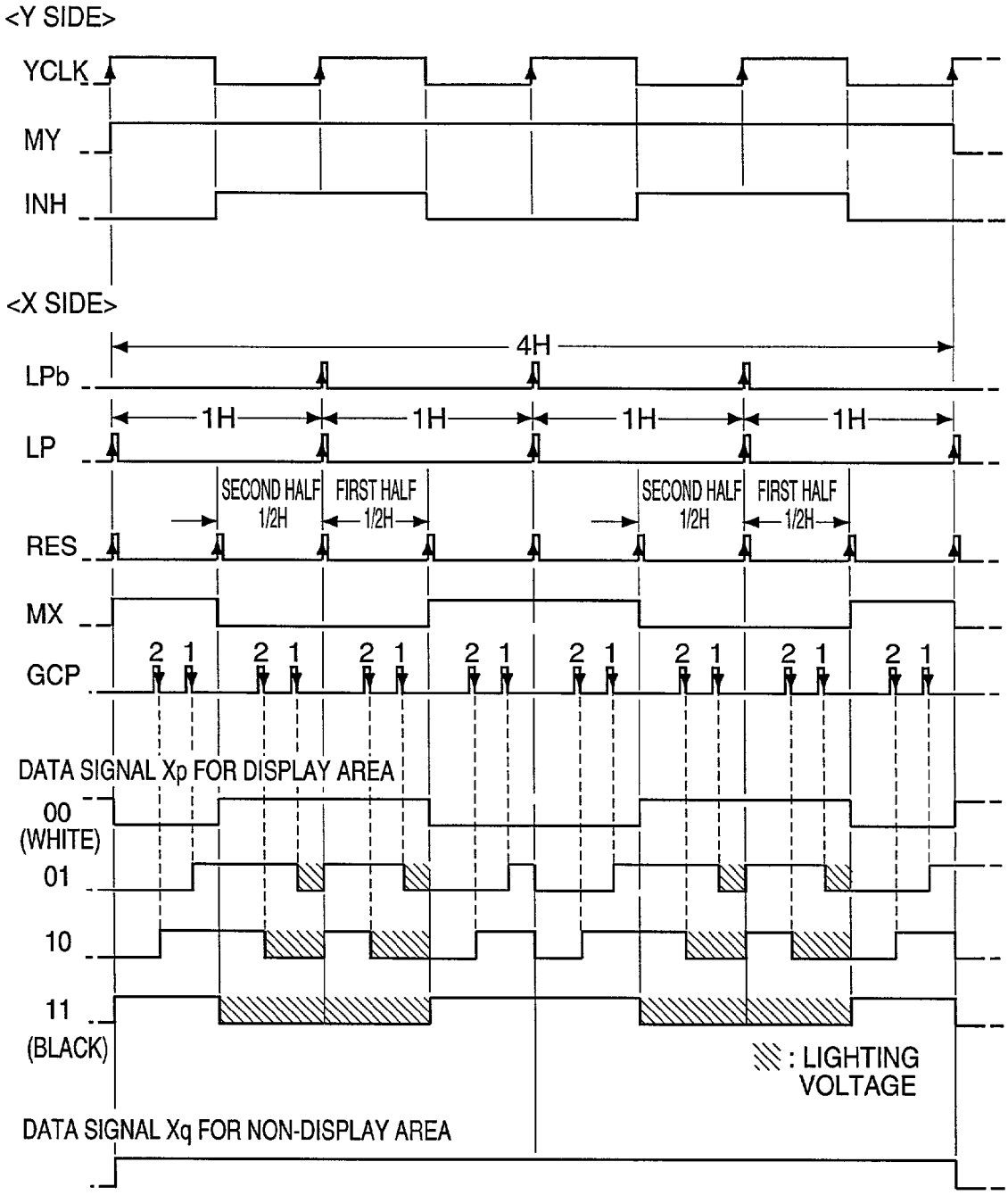
FIG. 18 is a timing chart showing the operation of the X driver in the display device.

Instead of the latch pulse LPa of the first embodiment, a latch pulse LPb is supplied to the PWM decoder 2506 (see FIG. 10) in the X driver 250 in the second embodiment. Referring to FIG. 18, the latch pulse LPb is the latch pulse LP defining the beginning of the one horizontal scanning period 1H, less the one that is output at the timing the alternating driving signal MY is transitioned in logical level.

In the second embodiment, the PWM decoder 2506 generates the following voltage selecting signal in response to a signal such as latch pulse LPb when the partial display control signal PDy is at a high level. Specifically, when a single piece of the gradation data Dn represents an intermediate gradation (gray) level display other than the on display and the off display, the PWM decoder 2506 resets the voltage selecting signal to have a polarity opposite to the polarity specified by the logical level of the alternating driving signal MX, at the rising edge of the latch pulse LPb, and then sets the voltage selecting signal to have the same polarity as that of the logical level of the alternating driving signal MX at the falling edge corresponding to the gradation data Dn out of the gradation code pulse GCP. When the gradation data Dn is (00) for the off (white) display, the PWM decoder 2506 generates the voltage selecting signal to have a polarity opposite to the polarity represented by the logical level of the alternating driving signal MX, using the reset signal RES. When the gradation data Dn is (11) for the on (black) display, the PWM decoder 2506 generates the voltage selecting signal to have the same polarity as that represented by the logical level of the alternating driving signal MX, using the reset signal RES. That operation in the second embodiment remains unchanged from that in the first embodiment.

The voltage waveform of the data signal supplied from the X driver 250 in the second embodiment is shown in FIG. 18 when the partial display control signal PDy is at a high level. Specifically, the selection voltage of the scanning signal is applied for the second half period in the odd row scanning line 312 and is then applied for the first half period in the even row scanning line 312 subsequent to the odd row scanning line 312. Similarly, the lighting voltage is also applied for the second half period and then for the first half period.

Figure 19:
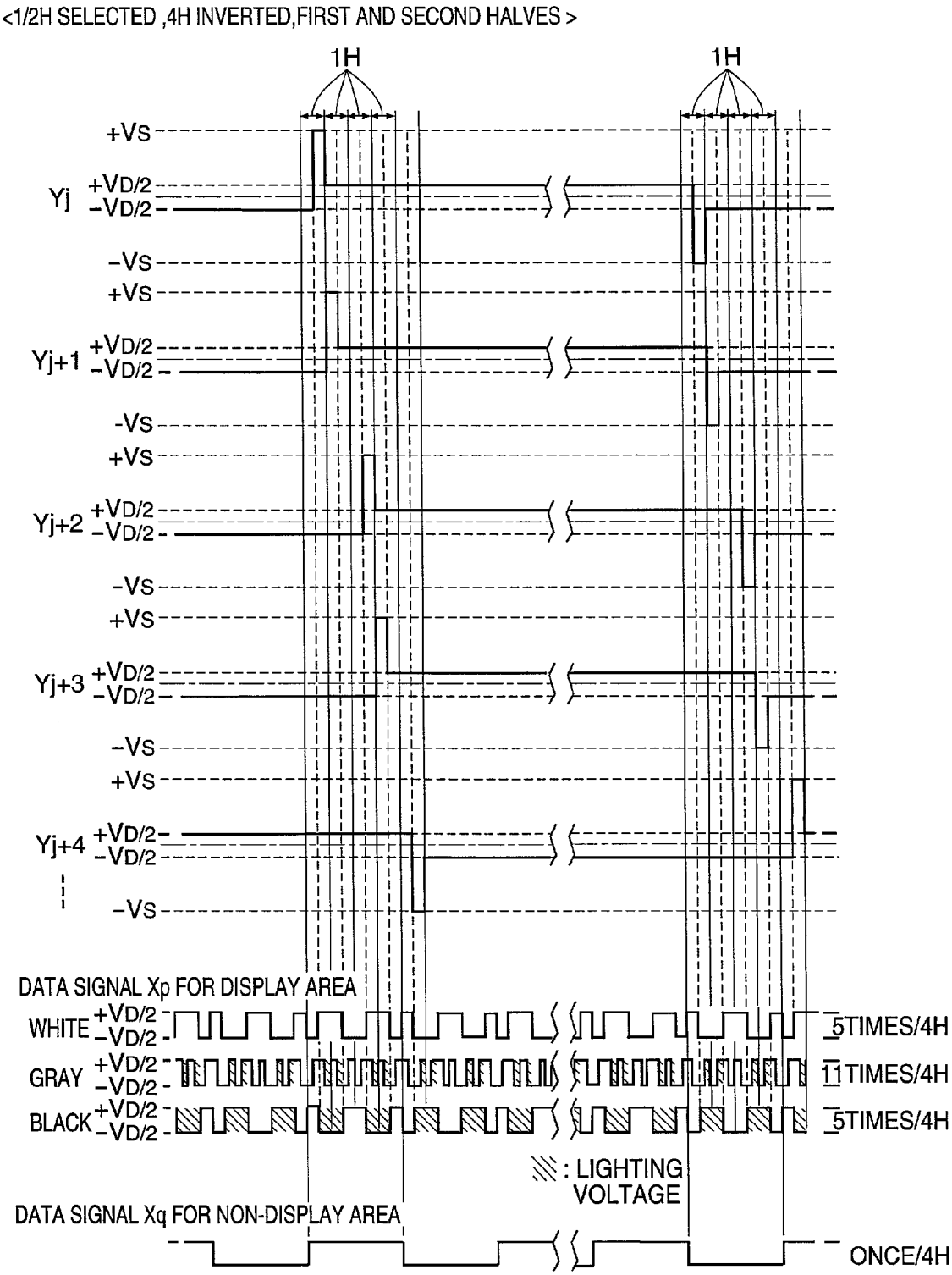
FIG. 19 is a timing chart showing waveforms and the gradation of pixels with a partial display control signal PDy at a high level.

Discussed next with reference to FIG. 19 are the frequency of voltage switching of the data signal Xp for the display area and the frequency of voltage switching of the data signal Xq for the non-display area when the partial display control signal PDy is at a high level. As shown, in this embodiment, the frequency of voltage switching of the data signal Xp for the duration during which the partial display control signal PDy remains at a high level is five times per four horizontal scanning periods 4H during which the scanning lines having the same polarity in the selection voltages are selected, when the off (white) display or the on (black) display appears contiguously in the direction of columns.

Generally in the second embodiment, the polarity inversion period of the selection voltage is set to be m horizontal scanning periods. In this arrangement, when the partial display control signal PDy is at a high level, the frequency of voltage switching of the data signal Xp to the data line 212 in the display area is (m+1) times per m horizontal scanning periods mH when pixels in the off (white) display or the on (black) display appear contiguously in the direction of columns. The frequency of voltage switching is small, compared with the modification of the first embodiment (see FIG. 11). The second embodiment further promotes power saving than the first embodiment.

In accordance with the second embodiment, when the partial display control signal PDy is at a high level, the voltage switching frequency of the data signal Xp to the pixels of the off (white) display or the on (black) display is set to be smaller than that in the first embodiment. The frequency of voltage switching of the data signal Xp for the pixels of the gray display is eleven times per four horizontal scanning periods 4H in this embodiment. Generally, with the polarity inversion period of the selection voltage set to be m horizontal scanning periods, the frequency of voltage switching becomes (3 m−1) times per m horizontal scanning periods mH, and is therefore higher than that in the first embodiment.

Beside a third embodiment to be described later, the following arrangement resolves this problem. Since the partial display shown in FIG. 5 requires only the minimum amount of information in the display area, the gray display is left unpresented by referencing only the most significant bit of the gradation data Dn to force the on display or the off display. The gray display is thus inhibited from being presented. In the arrangement with the gray display inhibited in the display area, the gray display requiring substantial power consumption is unpresented. This arrangement reduces not only the frequency of voltage switching of the data signal Xq to the non-display area but also the frequency of voltage switching of the data signal Xp to the pixels for the off (white) display or the on (black) display in the display area. Accordingly, power saving can be promoted even further.

Figure 20:
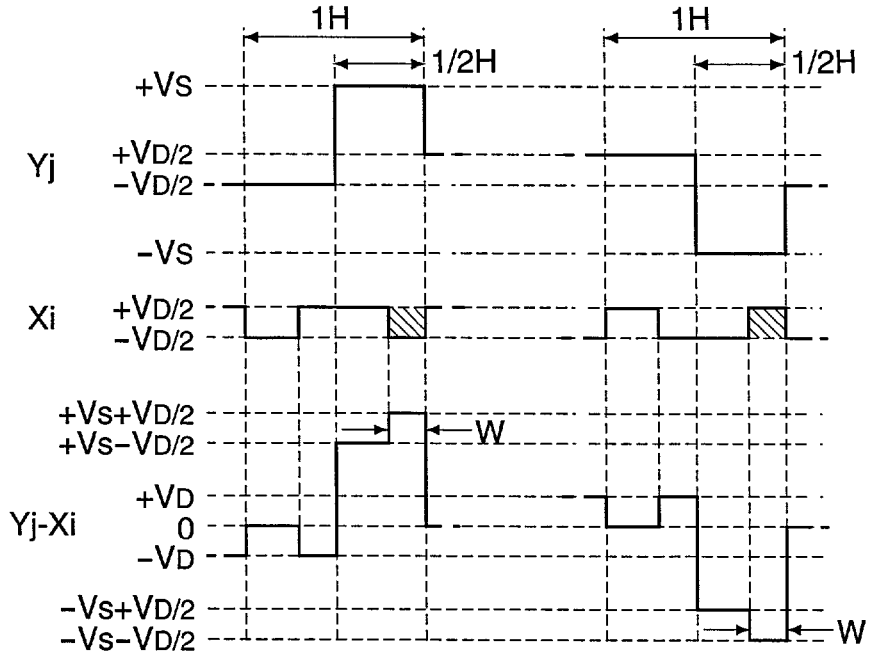
FIG. 20(*a*) shows a right-shifted modulation method, and FIG. 20(*b*) shows a left-shifted modulation method.
Figure 20:
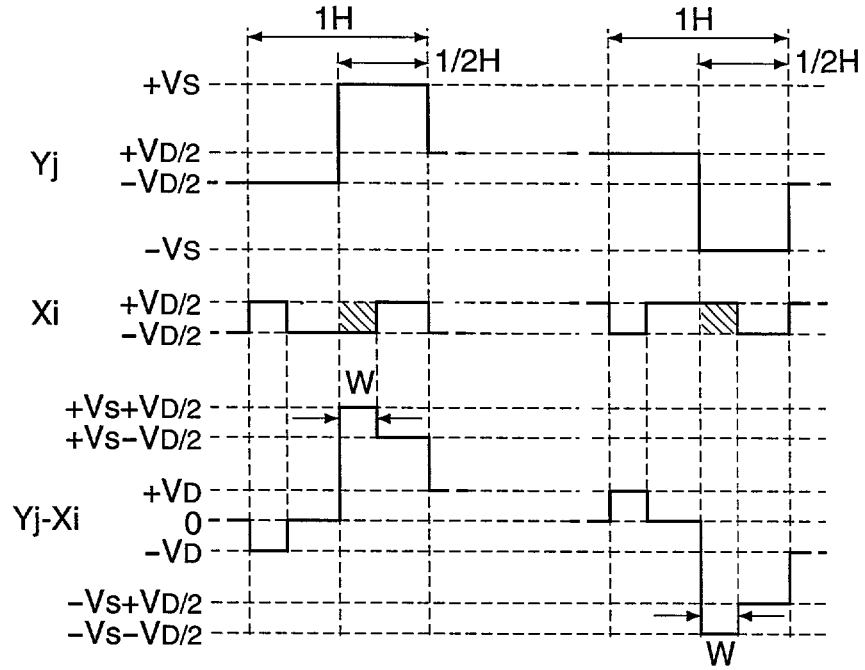

Before the discussion of the display device of a third embodiment of the present invention, a typical driving method for presenting a gradation display will be described. Gradation display methods are roughly divided into voltage modulation and pulse width modulation. The voltage modulation can be difficult, because voltage control to present a predetermined gradation level is difficult. Pulse width modulation is thus widely used. When pulse width modulation is applied to the four-value driving method (with ½H selected), three methods are available: a right-shifted modulation method in which the lighting voltage is applied at the end of the selection period as shown in FIG. 20(*a*), a left-shifted modulation method in which the lighting voltage is applied at the beginning of the selection period as shown in FIG. 20(*b*), and a dispersal modulation method (not shown) in which the lighting voltage having a time length corresponding to the weight of each bit in the gradation data is dispersed over a selection period. As described above, the lighting voltage refers to the data voltage, having the polarity opposite to the selection voltage $\pm V_S$ during the application period of the selection voltage, of the data voltage applied to the data line 212, and is the voltage that contributes to the writing of the pixel 116.

Among the three driving methods, both the left-shifted modulation and the dispersal modulation cause discharging subsequent to the writing of the lighting voltage. This can present difficulty in the control of gradation, and moreover, requires a higher driving voltage. When the gradation display is presented in the four- value driving method, the right-shifted modulation shown in FIG. 20(*a*) is typically used.

The right-shifted modulation is used to present the gradation display in the four-value driving method. The scanning lines in the display area are consecutively selected, and the pixel 116 in a p-th column in the display area is in the off (white) display or in the on (black) display. The frequency of voltage switching of the data signal Xp to the corresponding column is (2m−1) per m horizontal scanning periods mH in the first and second embodiments when the polarity inversion period of the selection voltage is every m horizontal scanning periods mH (here, m is 2 or larger integer). By increasing the number m, the frequency of voltage switching is set to be closer and closer to once per horizontal scanning period.

When a pixel 116 in any given column is at an intermediate gradation level (in a gray display), the frequency of voltage switching of the data signal Xp to the column becomes (3m−1) per m horizontal scanning periods mH in the second embodiment as shown in FIG. 19, and thus tends to increase on the contrary. If the ratio of the pixels for presenting a gray display increases in the display area in the partial display mode, the frequency of voltage switching of the data signal Xp increases, thereby canceling out the effect of a drop in the frequency of voltage switching of the data signal Xq in the non-display area.

Figure 21:
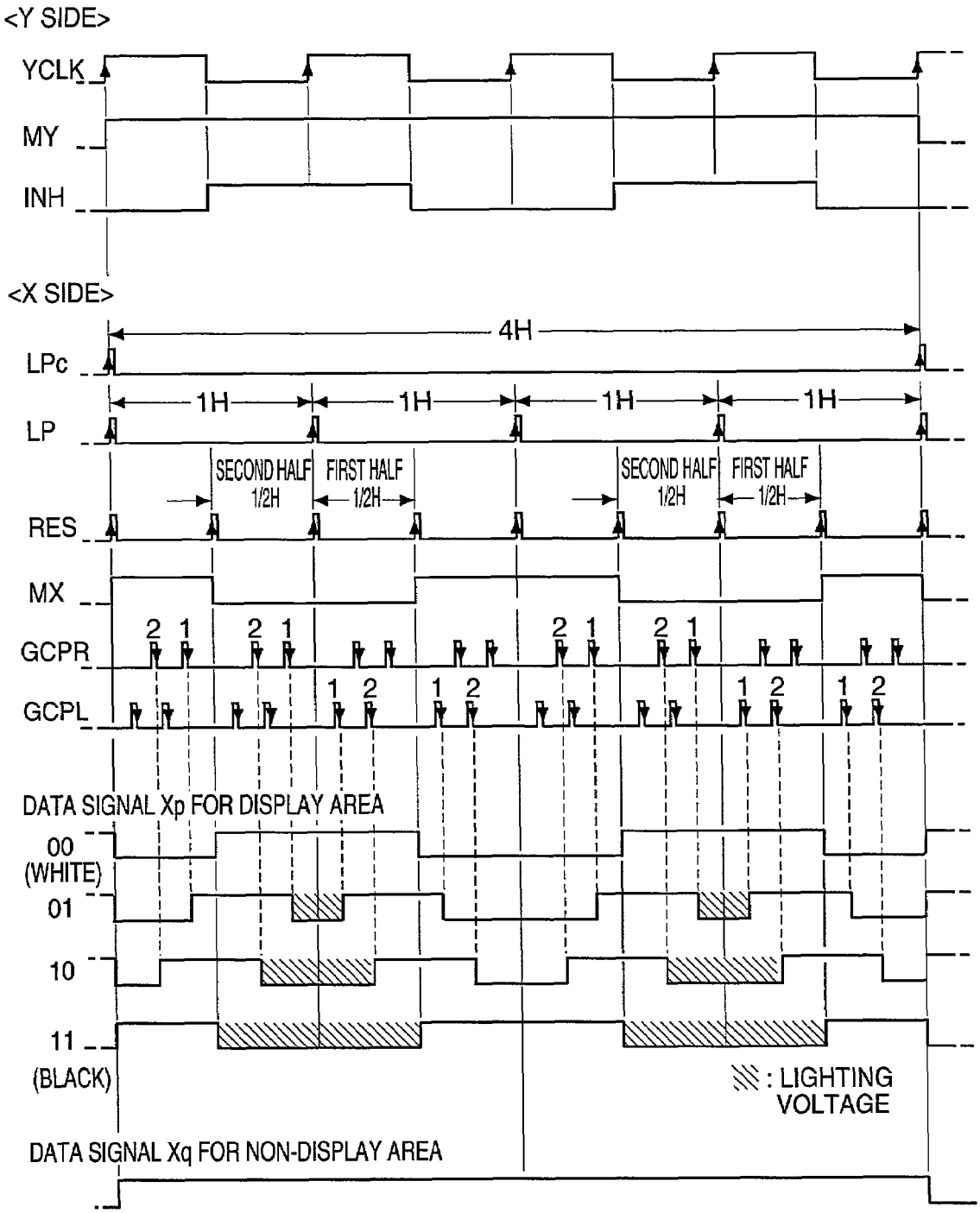
FIG. 21 is a timing chart showing the operation of the X driver in a display device of a third embodiment of the present invention.

Referring to FIG. 21, the display device of the third embodiment of the present invention uses the right-shifted modulation when the selection voltage is applied for the second half period ½H of one horizontal scanning period while using the left-shifted modulation when the selection voltage is applied for the first half period ½H of one horizontal scanning period. The lighting voltage is thus applied contiguously from the second half period to the first half period so that the frequency of voltage switching of the data signal Xp for the gray display is lowered.

The display device of the third embodiment will now be discussed. The display device is different from that in the second embodiment in the control signal in the X side. The third embodiment is mechanically and electrically identical to the second embodiment. The discussion of the third embodiment focuses the difference from the second embodiment.

Like the second embodiment, the third embodiment employs the polarity inversion period of the selection voltage of four horizontal scanning periods 4H. More specifically, the logical level of the alternating driving signal MY is inverted every four horizontal scanning periods 4H in which four scanning lines 312 are selected, for example, of the first through fourth rows, the fifth through eighth rows, the ninth through twelfth rows, . . . , the 197th through 200th rows.

In the third embodiment, as in the second embodiment, shown in FIG. 17, the control signal INH has twice the period of the clock signal YCLK, and remains high for the second half of one horizontal scanning period for selecting an odd row scanning line 312 and for the first half of one horizontal scanning period for selecting a next even row scanning line 312.

Figure 22:
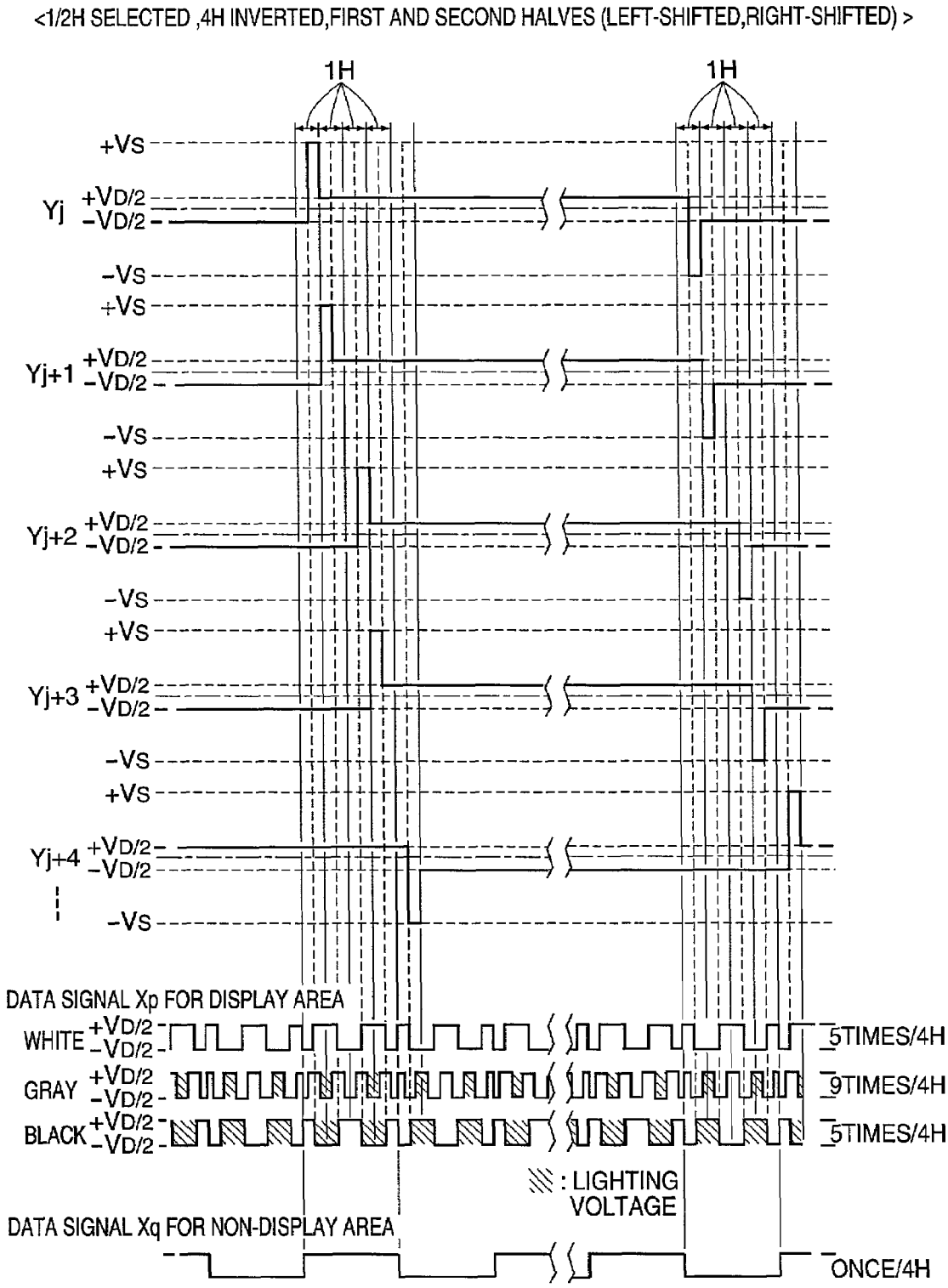
FIG. 22 is a timing chart showing the relationship between waveforms in the X driver and the Y driver and a pixel display mode with the partial display control signal PDy at an high level.

Referring to FIG. 22, in the third embodiment, the selection voltage of the scanning signal is applied for the second half of the one horizontal scanning period 1H during which the odd row scanning line 312 is selected, and for the subsequent even row scanning line 312, the selection voltage is applied for the first half of the one horizontal scanning period 1H, during which the scanning line is selected. In that sense, the third embodiment is identical to the second embodiment.

On the X side, the alternating driving signal Mx in the third embodiment remains unchanged from that in the second embodiment. Specifically, the logical level of the alternating driving signal MX is an inverted version of the logical level of the alternating driving signal MY when the control signal INH is at a high level. The logical level of the alternating driving signal MX remains the same as that of the alternating driving signal MY when the control signal INH is at a low level. In that sense, the third embodiment is identical to the first embodiment. Since the alternating driving signal MY and the control signal INH are modified in the third embodiment, the alternating driving signal MX is modified accordingly.

Instead of the latch pulse LPb in the second embodiment, a latch pulse LPc is supplied to the PWM decoder 2506 (see FIG. 8) in the X driver 250 in the third embodiment. Instead of the gradation code pulse GCP in the second embodiment, a right-shifted modulation gradation code pulse GCPR and a left-shifted modulation gradation code pulse GCPL are supplied to the PWM decoder 2506 (see FIG. 8) in the X driver 250 in the third embodiment. Referring to FIG. 21, the latch pulse LPc is the one that is output at the timing the alternating driving signal MY is transitioned in logical level, extracted from the latch pulse LP defining the beginning of the horizontal scanning period 1H. The right-shifted modulation gradation code pulse GCPR is a gradation control pulse for use in the right-shifted modulation. Referring to FIG. 21, the right-shifted modulation gradation code pulse GCPR is arranged at a point determined by a duration corresponding to an intermediate gradation level prior to the end of each of the first half period and the second half period into which one horizontal scanning period 1H is divided. The right-shifted modulation gradation code pulse GCPR is identical to the gradation code pulse GCP in the first and second embodiments. On the other hand, the left-shifted modulation gradation code pulse GCPL is a gradation control pulse for use in the left-shifted modulation. Referring to FIG. 21, the left-shifted modulation gradation code pulse GCPL is arranged at a point determined by a duration corresponding to an intermediate gradation level from the beginning of each of the first half period and the second half period into which one horizontal scanning period 1H is divided.

In the third embodiment, the PWM decoder 2506 generates the following voltage selecting signal in response to the latch pulse LPc, the right-shifted modulation gradation code pulse GCPR, and the left-shifted modulation gradation code pulse GCPL when the partial display control signal PDy is at a high level. Specifically, a latch pulse LP, which is supplied at the moment the latch pulse LPc is supplied, is referred to as a first latch pulse LP. The PWM decoder 2506 regards each of a duration from the first latch pulse LP till a second latch pulse LP and a duration from a third latch pulse LP to a fourth latch pulse LP, as one horizontal scanning period with the selection voltage supplied within the second half period thereof. The PWM decoder 2506 regards each of a duration from the second latch pulse LP till the third latch pulse LP and a duration from the fourth latch pulse LP to a next latch pulse LP, as one horizontal scanning period with the selection voltage supplied within the first half period thereof.

The PWM decoder 2506 recognizes the one horizontal scanning period with the selection voltage to be supplied within the second half period thereof for the duration during which the partial display control signal PDy is at a high level. When a single piece of the gradation data Dn represents an intermediate gradation (gray) level display other than the on display and the off display, the PWM decoder 2506 resets the voltage selecting signal to have the same polarity as that represented by the immediately prior logical level of the alternating driving signal MX, at the rising edge of the latch pulse LP, and then sets the voltage selecting signal to have the same polarity as that of the logical level of the alternating driving signal MX at the falling edge corresponding to the gradation data Dn out of the right-shifted modulation gradation code pulse GCPR within the first half period, and the PWM decoder 2506 then again sets the voltage selecting signal to have the same polarity as that of the logical level of the alternating driving signal MX at the falling edge corresponding to the gradation data Dn out of the right-shifted modulation gradation code pulse GCPR within the second half period.

The PWM decoder 2506 recognizes the one horizontal scanning period with the selection voltage to be supplied within the first half period thereof for the duration during which the partial display control signal PDy is at a high level. When a single piece of the gradation data Dn represents an intermediate gradation (gray) level display other than the on display and the off display, the PWM decoder 2506 resets the voltage selecting signal to have the same polarity as that of the polarity specified by the logical level of the alternating driving signal MX, at the rising edge of the latch pulse LP, and then sets the voltage selecting signal to have a polarity opposite to the polarity of the logical level of the alternating driving signal MX at the falling edge corresponding to the gradation data Dn out of the left-shifted modulation gradation code pulse GCPL within the first half period, and the PWM decoder 2506 then again sets the voltage selecting signal to have a polarity opposite to the polarity as that of the logical level of the alternating driving signal MX at the falling edge corresponding to the gradation data Dn out of the right-shifted modulation gradation code pulse GCPR within the second half period.

When the gradation data Dn is (00) for the off (white) display, the PWM decoder 2506 generates the voltage selecting signal to have a polarity opposite to the polarity represented by the logical level of the alternating driving signal MX, using the reset signal RES even when the PWM decoder 2506 recognizes the one horizontal scanning period with the selection voltage to be supplied within the first half period or the second half period thereof for the duration during which the partial display control signal PDy is at a high level. When the gradation data Dn is (11) for the on (black) display, the PWM decoder 2506 generates the voltage selecting signal to have the same polarity as that represented by the logical level of the alternating driving signal MX, using the reset signal RES. That operation in the third embodiment remains unchanged from that in the first embodiment.

The voltage waveform of the data signal supplied from the X driver 250 in the third embodiment is shown in FIG. 21 when the partial display control signal PDy is at a high level. Specifically, when the selection voltage is applied a scanning line 312 for the second half period within a duration during which the partial display control signal PDy remains at a high level, the lighting voltage is applied in the right-shifted modulation method. When the selection voltage is applied to the scanning line 312 subsequent to the first scanning line 312 for the first half period, the lighting voltage is applied in the left-shifted modulation method. As a result, the lighting voltage is applied contiguously from the second half to the first half.

Discussed next with reference to FIG. 22 are the frequency of voltage switching of the data signal Xq for the display area and the frequency of voltage switching of the data signal Xp to a pixel of the gray display when the partial display control signal PDy is at a high level in the third embodiment. As shown, in this embodiment, the frequency of voltage switching of the data signal Xp for the duration during which the partial display control signal PDy remains at a high level is nine times per four horizontal scanning periods 4H in the third embodiment. Generally, with the polarity inversion period of the selection voltage set to be m horizontal scanning periods, the frequency of voltage switching is (2 m+1) times per m horizontal scanning periods mH, as in the first embodiment.

In the third embodiment, the frequency of voltage switching of the data signal Xp for the duration during which the partial display control signal PDy remains at a high level is five times per four horizontal scanning periods 4H during which the scanning lines having the same polarity in the selection voltages are selected, when pixels in the off (white) display or the on (black) display appear contiguously in the direction of columns as in the second embodiment. Generally, with the polarity inversion period of the selection voltage set to be m horizontal scanning periods, the frequency of voltage switching of the data signal Xp to the data line 212 in the display area is (m+1) times per m horizontal scanning periods mH.

In accordance with the third embodiment, the frequency of voltage switching of the data signal Xp for the pixels of the off (white) display or the on (black) display, out of the frequency of voltage switching of the data signal Xq in the display area, is set to be as small as that in the second embodiment, when the partial display control signal PDy is at a high level. Moreover, the frequency of voltage switching of the data signal Xp for the pixels of the gray display is set to be as low as that in the first embodiment.

The first, second, and third embodiments of the present invention reduce power required to present the partial display shown in FIG. 5, by reducing the frequency of voltage switching, in comparison with the case in which the data signal Xq supplied to the data line in the non-display area is simply set to be a signal for an off display for a duration during which the partial display control signal PDy remains at a high level, in other words, during which the scanning lines assigned to the display area are scanned.

Since the second half period ½H of one horizontal scanning period and the first half period ½H of the next horizontal scanning period are paired in accordance with the second embodiment and the third embodiment, the number m representing the polarity inversion period of the selection voltage is an even number equal to or greater than two. Alternatively, the number m may be an odd number. If the number m is an odd number, one horizontal scanning period unpaired occurs, but this does not affect the frequency of voltage switching of the data signals Xp and Xq.

In each of the above embodiments, the partial display control data PDx identifying the data line 212 for the non-display is fed to the PWM decoder 2506. Alternatively, the partial display control data PDx may be fed to the address control circuit 2502 to inhibit the generation of the read address Rad of the gradation data Dn corresponding to the data. The PWM decoder 2506 regards the unread gradation data Dn as the one unpresented, and generates the voltage selecting signal for the data signal Xq.

In each of the above embodiments, the transmissive type display device has been described. Alternatively, the display device may be of a reflective type or a transflective type. When the display device is of a reflective type, the pixel electrode 234 is formed of a reflective metal such as aluminum or a reflective layer may be separately formed so that light from the counter substrate 300 is reflected there. When the display device is of a transflective type, an extremely thin pixel electrode 234 of a reflective metal or an extremely thin reflective layer may be arranged and an aperture portion may be arranged. In a reflective mode, light from the counter substrate 300 is reflected, and in a transmissive mode, illumination light from a backlight unit is transmitted therethrough.

In each of the above embodiments, the four gradation level display with two bit gradation data Dn is presented. However, it is to be understood that the present invention is not limited to this arrangement. A multi-gradation of three bits or more may be presented. A color display with pixels corresponding to R (red), green (G), and B (blue) may be also presented.

Referring to FIG. 1, the TFD 220 is connected to the data line 212, and the liquid-crystal layer 118 is connected to the scanning line 312. Conversely, the TFD 220 may be connected to the scanning line 312, and the liquid-crystal layer 118 may be connected to the data line 212.

The TFD 220 in the above-referenced liquid-crystal panel 100 is one example of switching elements. Alternatively, the switching element may be such as an element of ZnO (zinc oxide) varistor, or MSI (Metal Semi-Insulator), or a two-terminal element composed of two elements of ZnO varistors connected in parallel or series in opposite directions or MSIs connected in parallel or in series in opposite directions. A three-terminal element such as a TFT (Thin Film Transistor) or an insulated gate field-effect transistor also may be employed.

When the three-terminal element is used as a switching element, both the data line 212 and the scanning line 312 need to cross on the element substrate 200. This arrangement increases the possibility of short-circuits. Moreover, the TFT itself, more complex in construction than the TFD, requires a complex manufacturing process. The present invention may also be applied to a passive-type liquid-crystal having no switching element like the TFT or TFD.

The above embodiments uses the TN type liquid-crystal. However, it is to be understood that other types alternatively employed may be a BTN (Bi-stable Twisted Nematic) type/ferroelectric type employing a bi-stable twisted nematic liquid crystal having memory, a polymer dispersed type, a GH (guesthost) type in which a dye (guest) having anisotropy in the absorption of visible light in the minor axis and the major axis of molecules is dissolved in a liquid crystal (host) having a predetermined molecular arrangement and the dye molecules and the liquid-crystal molecules are arranged in parallel. Perpendicular alignment (homeotropic alignment) may be arranged in which the liquid-crystal molecules are perpendicularly aligned with respect to the two substrates with no voltage applied, and aligned in parallel to the two substrates with a voltage applied. On the other hand, parallel (planar) alignment (homogeneous alignment) may be arranged in which the liquid-crystal molecules are aligned in parallel to the two substrates with no voltage applied, and are perpendicularly aligned to the two substrates with a voltage applied. The present invention can be applied to a variety of types of liquid crystals and alignment methods without departing from the spirit and scope of the present invention.

In the above discussion, the display device employs the liquid crystal as an electro-optical material. Alternatively, the present invention is applied to a display device having an electro-optical effect, such as electro-optical devices including an electroluminescence, a fluorescent character display tube, or a plasma display. The present invention is thus applied to all types of display devices having a structure similar to that described above.

Electronic equipment incorporating the display device of each of the preceding embodiments will now be described.

Figure 28:
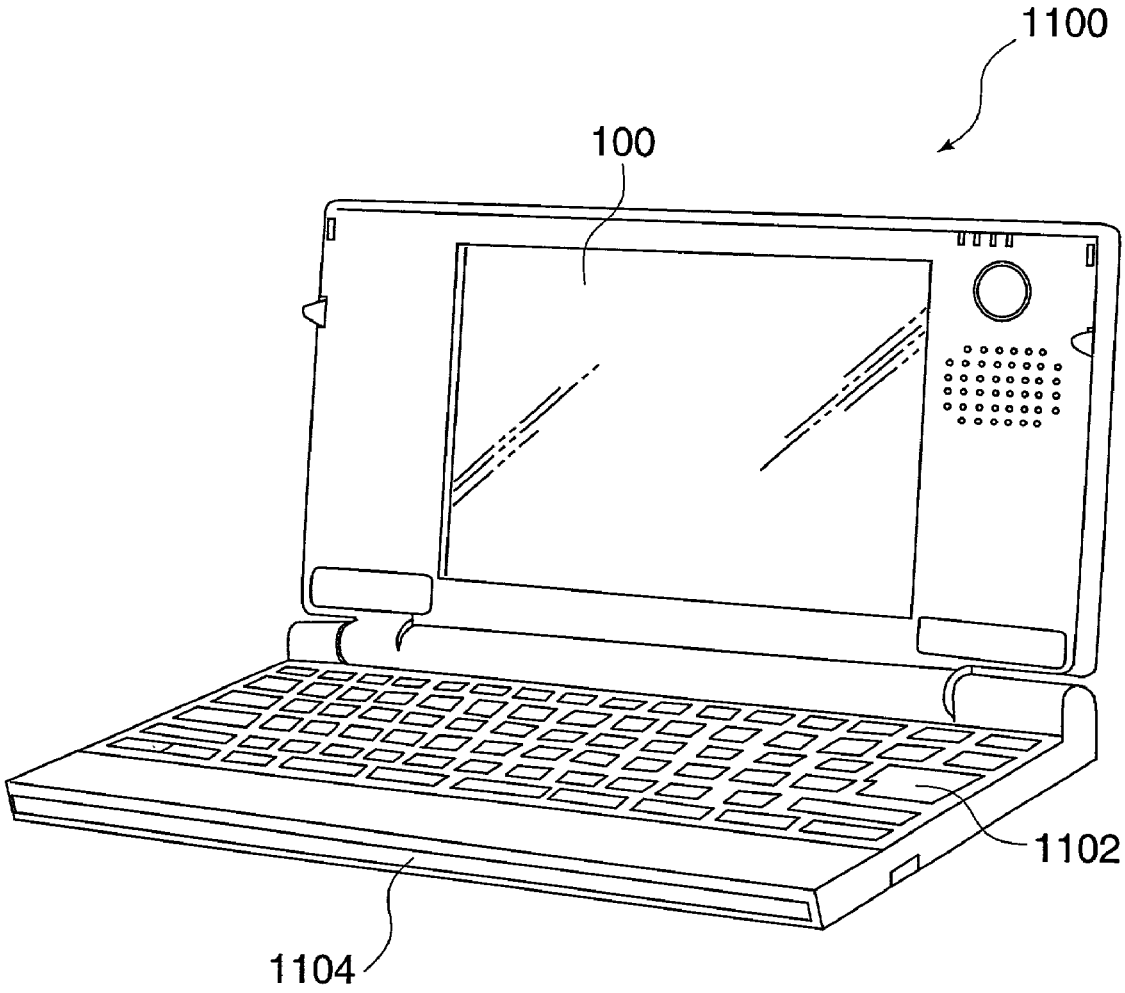
FIG. 28 is a perspective view showing the construction of a personal computer as one example of electronic equipment that incorporates the display device of each of the embodiments of the present invention.

Discussed here is the display device which is incorporated as a display unit in a mobile personal computer 1100. FIG. 28 is a perspective view showing the construction of the personal computer 1100. As shown, the personal computer 1100 includes a main unit 1104 with a keyboard 1102, and a liquid-crystal panel 100 as a display unit. Although a backlight unit is arranged behind the liquid- crystal panel 100 to enhance visibility of an image, the backlight unit is not shown in FIG. 28 because it does not appear in the external view of the mobile computer 1100.

Figure 29:
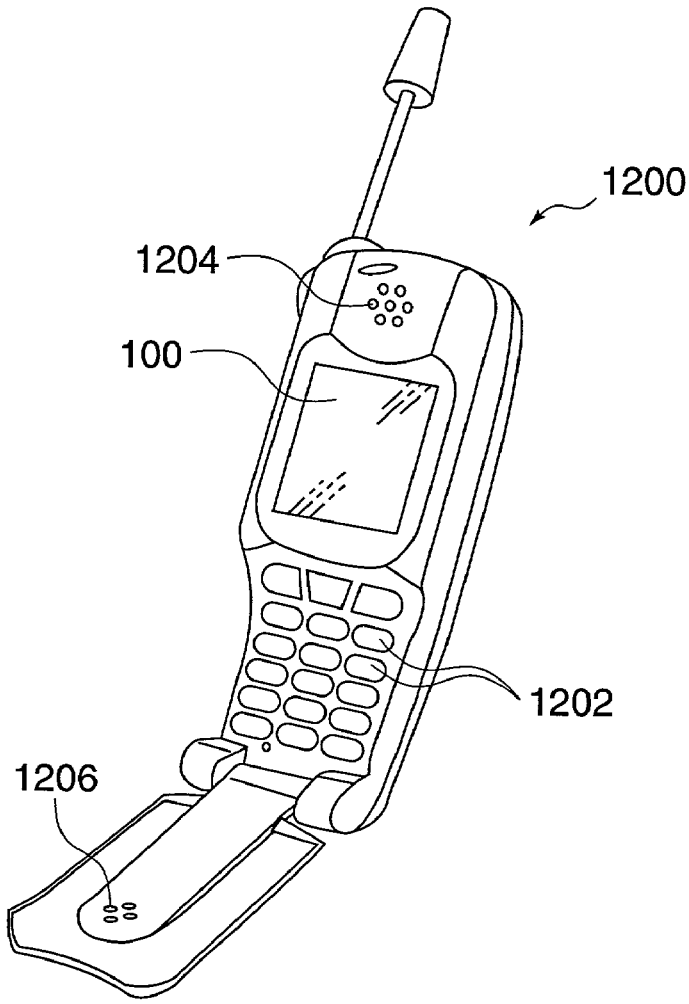
FIG. 29 is a perspective view showing the construction of a mobile telephone as one example of the electronic equipment that incorporates the display device of each of the embodiments of the present invention.

Discussed here is the display device which is incorporated as a display unit in a mobile telephone 1200. FIG. 29 is a perspective view showing the construction of the mobile telephone 1200. As shown, the mobile telephone 1200 includes a plurality of control buttons 1202, an ear piece 1204, a mouth piece 1206, and the liquid-crystal panel 100. The liquid-crystal panel 100 presents a full display with the entire area of the screen turned on at information arrival or information transmission, but presents a partial display when in a standby state, wherein the display presents required information only, such as an electric field intensity, numbers, characters, date and time. Since power consumed in a standby state is thus reduced, a long standby time is acceptable. A backlight unit, arranged behind the liquid crystal panel 100 to enhance visibility, is not shown in FIG. 29, because it does not appear in the external view of the mobile telephone 1200.

Figure 30:
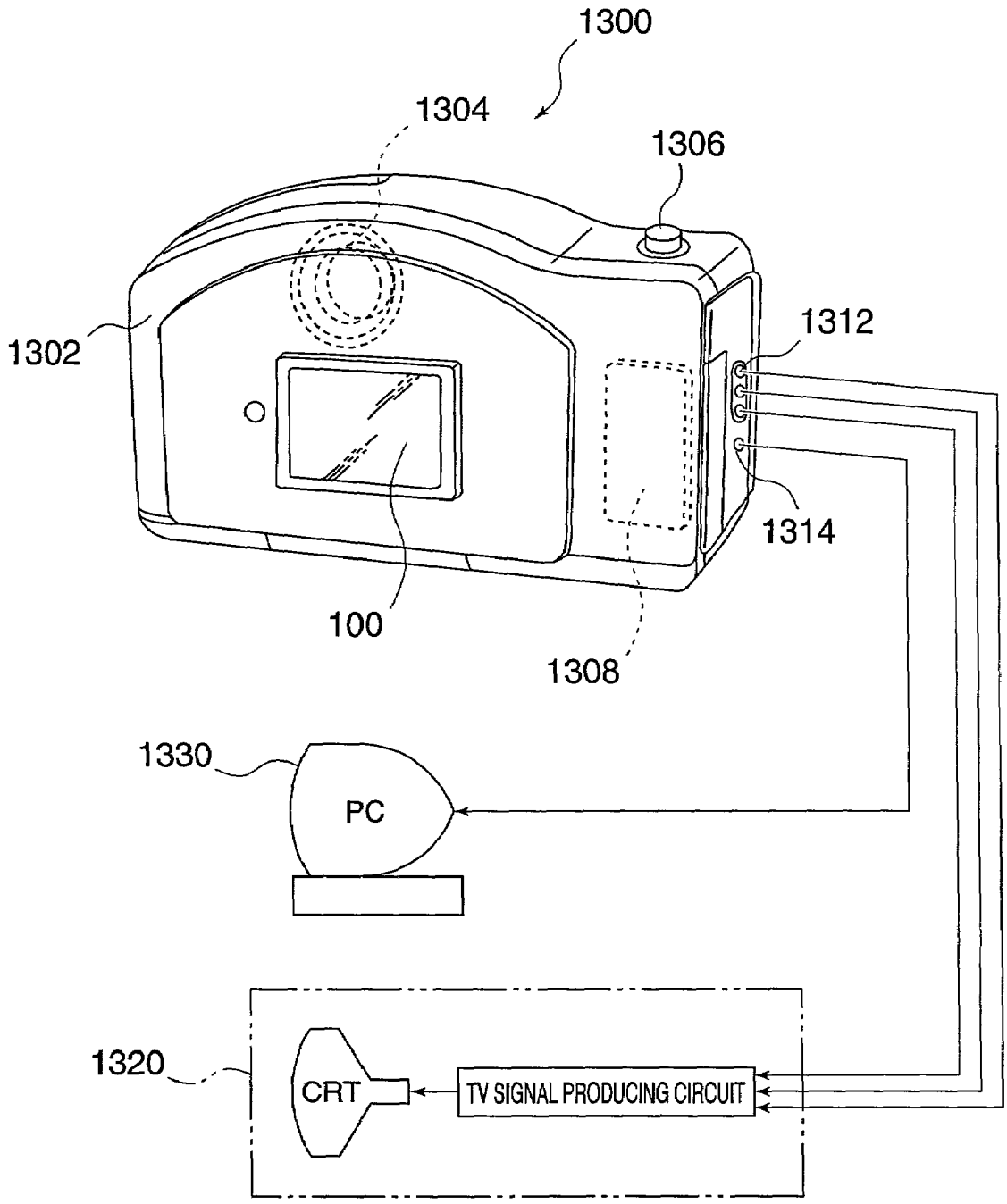
FIG. 30 is a perspective view showing the construction of a digital still camera as one example of the electronic equipment that incorporates the display device of each of the embodiments of the present invention.
Figure 31:
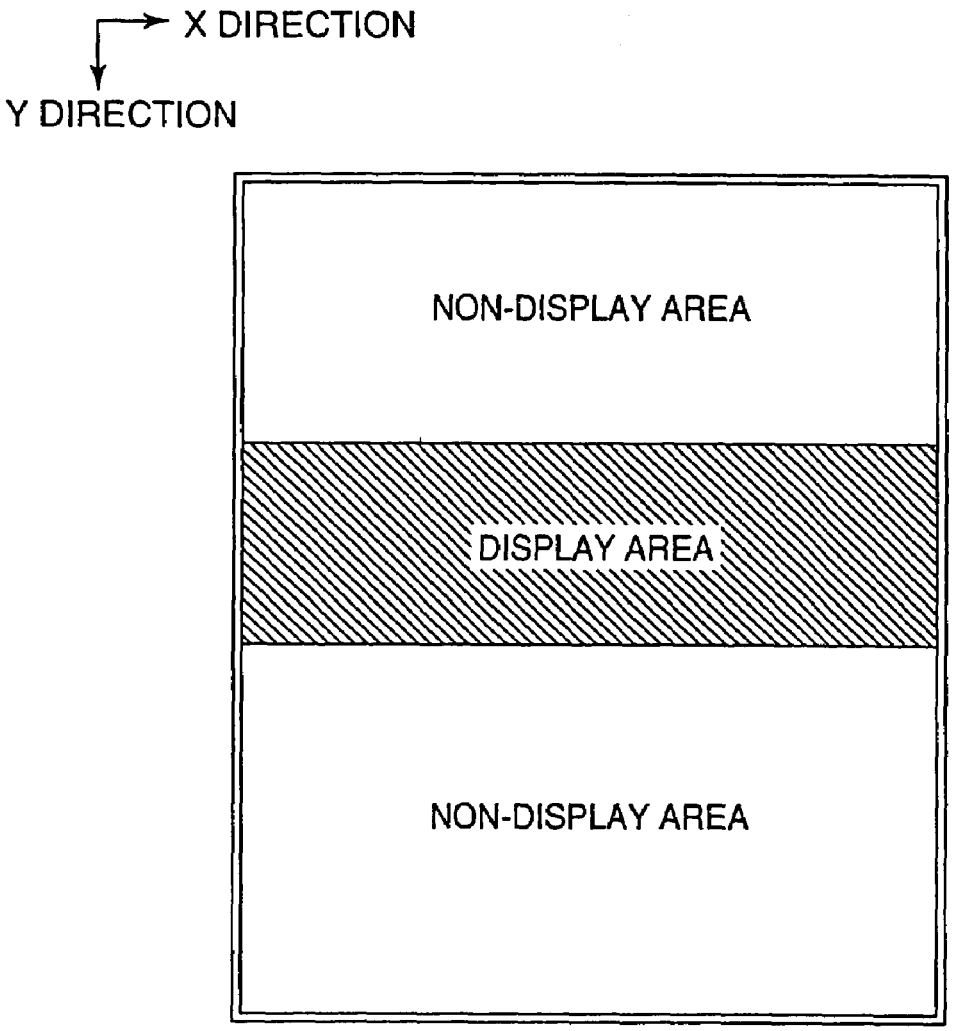
FIG. 31 RELATED ART
FIG. 31 shows a display mode on a conventional partial driving method.

Discussed next is a digital still camera 1300 that incorporates the above-referenced display device as a view finder. FIG. 30 is a perspective view showing the construction of the digital still camera 1300 and the main connection thereof with an external device.

In contrast with a silver-film camera that exposes a film to an optical image of an object, the digital still camera 1300 generates a video signal by photoelectrically converting an optical image of an object through an image sensor such as a CCD (Charge-Coupled Device). The above-referenced liquid-crystal panel 100 is mounted on the back of a case 1302 of the digital still camera 1300, said panel presenting a display based on CCD video signals. The liquid-crystal panel 100 functions as a view finder to display the image of the object. Arranged on the front of the case 1302 (behind the case 1302 in FIG. 30) is a photosensitive unit 1304 X including an optical lens and the CCD.

When a photographer presses a shutter button 1306 after recognizing the image of an object displayed on the liquid-crystal panel 100, the image taken by the CCD at the moment is transferred to and stored in a memory on a circuit board 1308. The digital still camera 1300 is provided on the side of the case 1302 with a video signal output terminal 1312 and an input/output terminal 1314 for data exchange. Additionally, as required, a television monitor 1320 can be connected to the video signal output terminal 1312, and a personal computer 1330 can be connected to the input/output terminal 1314 for data exchange. In response to predetermined operational steps, the video signal stored in the memory of the circuit board 1308 is output to the television monitor 1320 and the personal computer 1330.

Besides the personal computer shown in FIG. 28, the mobile telephone shown in FIG. 29, and the digital still camera shown in FIG. 30, the electronic equipment of the present invention may be any of a diversity of electronic equipment including, but not limited to a liquid-crystal display television, a viewfinder type or direct monitoring type video cassette recorder, a car navigation system, a pager, an electronic pocketbook, an electronic tabletop calculator, a word processor, a workstation, a video phone, a POS terminal, an apparatus having a touch panel and the like. These pieces of electronic equipment may incorporate the above- referenced display device.

In accordance with the present invention, as described above, only the pixels at the intersections of the particular scanning lines and the particular data lines are put into a display state while the remaining pixels are put into a non-display state. The frequency of voltage switching is reduced compared with the arrangement in which the non-lighting voltage is simply applied to the data lines other than the particular data lines, and power consumed in the voltage switching operation is thus lowered.

The invention claimed is:

1. A driving method of a display device for driving pixels which are arranged corresponding to each of intersections of a plurality of scanning lines and a plurality of data lines, comprising:

setting a pixel corresponding to each of intersections of particular ones of the plurality of scanning lines and particular ones of the plurality of data lines to be in a display state while the remaining pixels are set to be in a non-display state;

selecting a scanning line among the particular scanning lines every horizontal scanning period with a selection voltage supplied to the selected scanning line for one of two split halves of the one horizontal scanning period and with a non-selection voltage supplied to the selected scanning line for another of two split halves of the one horizontal scanning period, the polarity of the selection voltage being inverted with respect to an intermediate value between an on-display voltage and an off-display voltage, supplied to the data line, every two or more horizontal scanning periods;

supplying each of the scanning lines other than the particular scanning lines with a non-selection voltage which is inverted in polarity with respect to the intermediate value every one or more vertical scanning periods;

supplying each of the particular data lines with the on-display voltage or the off-display voltage in accordance with a content to be displayed on a pixel corresponding to an intersection of the selected scanning line and the particular data line for a period during which the selection voltage is supplied to the selected scanning line, within one horizontal scanning period for selecting one of the particular scanning lines, the particular data line being supplied with the on-display voltage and the off-display voltage for substantially equal periods within the one horizontal scanning period for the selected scanning line; and supplying the data line other than the particular data lines with the off-display voltage for a period during which the particular scanning lines are consecutively selected, in response to the polarity of the selection voltage supplied to the selected scanning lines, wherein the polarity of the off-display voltage is inverted in synchronization with the period of polarity inversion of the selection voltage.

2. The driving method of a display device according to claim 1, wherein:

when one of the particular scanning line is selected, the selected scanning line is supplied with the selection voltage for a second half of one horizontal scanning period;

when a subsequent scanning line is selected, the selected scanning line is supplied with the selection voltage for a first half of one horizontal scanning period; and the supply of the selection voltage alternates between during one half period and during the other half period, every one horizontal scanning period.

3. The driving method of a display device according to claim 2, wherein:

when the selection voltage is supplied during the second half period, the particular data line is supplied with the on-display voltage from a time earlier than an end of the second half period by the duration, corresponding to a tonal gradation of a pixel corresponding to an intersection of the selected scanning line and the particular data line, until the end of the second half period, and is supplied with the off-display voltage during the remaining time of the second half period; and when the selection voltage is supplied during the first half period, the particular data line is supplied with the on-display voltage from a beginning of the first half period until a time point later than the beginning of the first half period by the duration, corresponding to the tonal gradation of the pixel corresponding to the intersection of the selected scanning line and the particular data line, and is supplied with the off-display voltage during the remaining time of the first half period.

4. A driving method of a display device according to claim 1, wherein for a duration of time during which the scanning lines other than the particular scanning lines are consecutively selected, the data lines are supplied with a signal having a positive voltage portion and a negative voltage portion with respect to the intermediate value, the signal alternating between the positive voltage portion and the negative voltage portion with respect to the intermediate value every one or more horizontal scanning periods.

5. A driving method of a display device according to claim 4, wherein the polarity inversion period of the signal having the positive voltage portion and the negative voltage portion is a fraction of the horizontal scanning period, the fraction being determined by dividing the total number of the scanning lines other than the particular scanning lines by an integer number equal to two or more.

6. A driving circuit of a display device for driving pixels which are arranged corresponding to each of intersections of a plurality of scanning lines and a plurality of data lines, in which a pixel corresponding to each of intersections of particular ones of the plurality of scanning lines and particular ones of the plurality of data lines is set to be in a display state while the remaining pixels are set to be in a non-display state, the driving circuit comprising:

a scanning line driving circuit and a data line driving circuit;

wherein the scanning line driving circuit selects a scanning line among the particular scanning lines every horizontal scanning period with a selection voltage supplied to the selected scanning line for one of two split halves of the one horizontal scanning period and with a non-selection voltage supplied to the selected scanning line for another of two split halves of the one horizontal scanning period, inverts the polarity of the selection voltage with respect to an intermediate value between an on-display voltage and an off-display voltage, supplied to the data line, every two or more horizontal scanning periods, and supplies the scanning line other than the particular scanning lines with a non-selection voltage which is inverted in polarity with respect to the intermediate value every one or more vertical scanning periods, and the data line driving circuit supplies the particular data line with the on-display voltage or the off-display voltage in accordance with a content to be displayed on a pixel corresponding to an intersection of the selected scanning line and the particular data line for a period during which the selection voltage is supplied to the selected scanning line, within one horizontal scanning period for selecting one of the particular scanning lines, supplies the particular data line with the on-display voltage and the off-display voltage for substantially equal periods within the one horizontal scanning period for the selected scanning line, and supplies the data line other than the particular data line with the off-display voltage for a period during which the particular scanning lines are consecutively selected, in response to the polarity of the selection voltage supplied to the selected scanning lines, wherein the polarity of the off-display voltage is inverted in synchronization with the period of polarity inversion of the selection voltage.

7. The driving circuit of a display device according to claim 6, wherein when one of the particular scanning line is selected, the scanning line driving circuit supplies the selected scanning line with the selection voltage for a second half of one horizontal scanning period, and when a subsequent particular scanning line is selected, the scanning line driving circuit supplies the selected scanning line with the selection voltage for a first half of one horizontal scanning period, and the supply of the selection voltage alternates between during one half period and during the other half period, every one horizontal scanning period.

8. The driving circuit of a display device according to claim 7, wherein when the selection voltage is supplied during the second half period, the data line driving circuit supplies the particular data line with the on-display voltage from a time earlier than the end of a second half period by the duration, corresponding to a tonal gradation of a pixel corresponding to an intersection of the selected scanning line and the particular data line, until an end of the second half period, and is supplied with the off-display voltage during a remaining time of the second half period, and when the selection voltage is supplied during a first half period, the data line driving circuit supplies the particular data line with the on-display voltage from a beginning of the first half period until a time later than the beginning of the first half period by the duration corresponding to the tonal gradation of the pixel corresponding to the intersection of the selected scanning line and the particular data line, and is supplied with the off-display voltage during the remaining time of the first half period.

9. The driving circuit of a display device according to claim 6, wherein for a duration of time during which the scanning lines other than the particular scanning lines are consecutively selected, the data line driving circuit supplies the data line with a signal having a positive voltage portion and a negative voltage portion with respect to the intermediate value, the signal alternating between the positive voltage portion and the negative voltage portion with respect to the intermediate value every one or more horizontal scanning periods.

10. The driving circuit of a display device according to claim 9, wherein the polarity inversion period of the signal having the positive voltage portion and the negative voltage portion is approximately a fraction of the horizontal scanning period, and the fraction is determined by dividing the total number of the scanning lines other than the particular scanning lines by an integer number equal to two or more.

11. A display device for driving pixels that are arranged at each of intersections of a plurality of scanning lines and a plurality of data lines, in which a pixel corresponding to each of intersections of particular ones of the plurality of scanning lines and particular ones of the plurality of data lines is set to be in a display state while the remaining pixels are set to be in a non-display state, the display device comprising:

a scanning line driving circuit and a data line driving circuit, wherein the scanning line driving circuit selects a scanning line among the particular scanning lines every horizontal scanning period with a selection voltage supplied to the selected scanning line for one of two split halves of the one horizontal scanning period and with a non-selection voltage supplied to the selected scanning line for another of two split halves of the one horizontal scanning period, inverts a polarity of the selection voltage with respect to an intermediate value between an on-display voltage and an off-display voltage, supplied to the data line, every two or more horizontal scanning periods, and supplies the scanning line other than the particular scanning lines with a non-selection voltage which is inverted in polarity with respect to the intermediate value every one or more vertical scanning periods, and the data line driving circuit supplies the particular data line with the on-display voltage or the off-display voltage in accordance with a content to be displayed on a pixel corresponding to an intersection of the selected scanning line and the particular data line, for a period, during which the selection voltage is supplied to the selected scanning line, within one horizontal scanning period for selecting one of the particular scanning lines, supplies the particular data lines with the on-display voltage and the off-display voltage for substantially equal periods within the one horizontal scanning period for the selected scanning line, and supplies the data line other than the particular data lines with the off-display voltage for a period during which the particular scanning lines are consecutively selected, in response to the polarity of the selection voltage supplied to the selected scanning lines, wherein the polarity of the off-display voltage is inverted in synchronization with the period of polarity inversion of the selection voltage.

12. The display device according to claim 11, wherein the pixel further comprises:

a switching element and a capacitive element containing an electro-optical material, and wherein when one scanning line is supplied with the selection voltage, the switching element of the pixel assigned to the selected scanning line becomes conductive, and writing is performed on a capacitive element corresponding to the switching element in response to an on-display voltage supplied to the corresponding data line.

13. The display device according to claim 12, wherein the switching element is a two-terminal switching element, and the pixel is formed of the two- terminal switching element and the capacitive element connected in series between the scanning line and the data line.

14. The display device according to claim 13, wherein the two-terminal switching element has a structure of conductor-insulator-conductor connected to one of the scanning line and the data line.

15. Electronic equipment comprising a display device according to claim 11.

* * * * *